US007298352B2

(12) United States Patent
Kang et al.

(10) Patent No.: US 7,298,352 B2
(45) Date of Patent: Nov. 20, 2007

(54) APPARATUS AND METHOD FOR CORRECTING GAMMA VOLTAGE AND VIDEO DATA IN LIQUID CRYSTAL DISPLAY

(75) Inventors: Sin Ho Kang, Kumi-shi (KR); Kyeong Kun Jang, Kumi-shi (KR); Sang Tae Lee, Kumi-shi (KR); Jung Taeck Eu, Kumi-shi (KR); Kyu Ik Sohng, Daegu-shi (KR); Sang Hoon Lee, Daegu-shi (KR); Byung Joon Goo, Daegu-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 722 days.

(21) Appl. No.: 09/892,997

(22) Filed: Jun. 28, 2001

(65) Prior Publication Data

US 2002/0063666 A1 May 30, 2002

(30) Foreign Application Priority Data

Jun. 28, 2000 (KR) ..... 10-2000-36213
Dec. 29, 2000 (KR) ..... 10-2000-85270

(51) Int. Cl.
*G09G 3/36* (2006.01)

(52) U.S. Cl. ..... 345/87; 345/94; 345/98; 345/102

(58) Field of Classification Search ..... 345/87, 345/102, 94, 690, 603, 506, 202, 509–512, 345/507, 600, 211, 98, 502; 348/189, 383, 348/625, 745, 545, 572, 498, 665, 667; 358/301; 315/366, 666; 327/51; 341/144, 150, 145, 341/155

See application file for complete search history.

(56) References Cited

U.S. PATENT DOCUMENTS 4,250,525 A * 2/1981 Steckler et al. ..... 348/545
4,307,414 A * 12/1981 Lee ..... 348/665
4,511,858 A * 4/1985 Charavit et al. ..... 331/10
4,626,895 A * 12/1986 Reitmeier ..... 348/667
5,189,441 A * 2/1993 Fukui et al. ..... 347/253
5,291,102 A * 3/1994 Washburn ..... 315/383

(Continued)

FOREIGN PATENT DOCUMENTS

KR 10-2000-0023083 A 4/2000

*Primary Examiner*—Prabodh M. Dharia
(74) *Attorney, Agent, or Firm*—McKenna, Long & Aldridge, LLP

(57) ABSTRACT

A liquid crystal display that is capable of improving a display quality of the LCD is disclosed, wherein gamma data for controlling the gamma voltage is stored for each of at least two modes. The gamma data for each mode is accessed in response to a selected mode, and n gamma voltages (wherein n is an integer), each having a different voltage level, indicated by the gamma data in the selected mode are generated. A lookup table is provided in which a color temperature correction data for correcting a color temperature characteristic of an input image is set in correspondence with a gray level value of the input image. The lookup table is accessed to read out color temperature correction data corresponding to the gray level value of the input image. The data lines are driven by the color temperature correction data.

24 Claims, 21 Drawing Sheets

U.S. PATENT DOCUMENTS 5,319,450 A * 6/1994 Tamayama et al. ..... 348/692
5,399,947 A * 3/1995 Washburn ..... 315/383
5,739,803 A * 4/1998 Neugebauer ..... 345/98
5,760,548 A * 6/1998 Beeteson et al. ..... 315/366
5,790,096 A * 8/1998 Hill, Jr. ..... 345/600
5,872,556 A * 2/1999 Rackley et al. ..... 345/603
5,877,717 A * 3/1999 Tu et al. ..... 341/150
6,115,022 A * 9/2000 Mayer et al. ..... 345/418
6,137,462 A * 10/2000 Kim ..... 345/94
6,157,396 A * 12/2000 Margulis et al. ..... 345/506
6,169,505 B1 * 1/2001 Nishimura et al. ..... 341/141
6,184,855 B1 * 2/2001 Kobayashi et al. ..... 345/100
6,225,931 B1 * 5/2001 Rao et al. ..... 341/144
6,255,978 B1 * 7/2001 Chang et al. ..... 341/155
6,256,010 B1 * 7/2001 Chen et al. ..... 345/690
6,281,944 B1 * 8/2001 Kim ..... 348/674
6,297,851 B1 * 10/2001 Taubman et al. ..... 348/572
6,340,994 B1 * 1/2002 Margulis et al. ..... 348/625
6,404,512 B1 * 6/2002 Tone ..... 358/3.01
6,456,340 B1 * 9/2002 Margulis ..... 348/745
6,535,192 B1 * 3/2003 Sung et al. ..... 345/94
6,563,898 B1 * 5/2003 Vourvopoulos et al. ..... 376/159
6,570,611 B1 * 5/2003 Satou et al. ..... 348/189
6,611,249 B1 * 8/2003 Evanicky et al. ..... 345/102
6,771,238 B1 * 8/2004 Hiroki ..... 345/87
6,987,499 B2 * 1/2006 Yamaguchi et al. ..... 345/89
7,068,292 B2 * 6/2006 Morita ..... 345/690
2002/0041245 A1 * 4/2002 Brownlow et al. ..... 341/145
2002/0063807 A1 * 5/2002 Margulis ..... 348/745
2002/0126077 A1 * 9/2002 Baek ..... 345/87
2002/0145600 A1 * 10/2002 Morita ..... 345/211
2003/0160897 A1 * 8/2003 Park ..... 348/498
2004/0017224 A1 * 1/2004 Tumer et al. ..... 327/51
2005/0117054 A1 * 6/2005 Higashi ..... 348/383

* cited by examiner

S=START CONDITION ,A3~A0=ADDRESS BIT, SC~SA=SUBADDRESS BIT
A=HEADER BIT, D5~D0=DATA BIT

- CHROMINANCE CO-ORDINATES OF INPUT IMAGE
- CHROMINANCE CO-ORDINATES OF LCD DISPLAY IMAGE
- CHROMINANCE CO-ORDINATES CORRECTED BY LOOKUP TABLE

APPARATUS AND METHOD FOR CORRECTING GAMMA VOLTAGE AND VIDEO DATA IN LIQUID CRYSTAL DISPLAY

CROSS REFERENCE TO RELATED APPLICATIONS

This application claims benefit of Korean Patent Application No. P2000-8520, filed on 29 Dec. 2000 and Korean Patent Application No. 2000-36213, filed on 28 Jun. 2000, the entirety of each of which are hereby incorporated by reference for all purposes as if fully set forth herein.

BACKGROUND OF THE INVENTION

1. Field of the Invention

This invention relates to a technique for driving a liquid crystal display, and more particularly to an apparatus and method for correcting a gamma voltage and a video data in a liquid crystal display that is capable of improving a display quality of the liquid crystal display.

2. Description of the Related Art

Generally, an active matrix liquid crystal display (LCD) uses thin film transistors (TFTs) as switching devices to display a natural moving picture. Since such a LCD can be made into a smaller device in size than the existent Brown tube, it has been widely used for a monitor for a personal computer or a notebook computer as well as office automation equipment such as copy machines, etc. and portable equipment such as cellular phones and pagers, etc.

As shown in FIG. 1, a driving apparatus for the LCD includes a digital video card 1 for converting an analog signal into a digital video data, a column driver 3 for applying the video data to data lines DL of a liquid crystal panel 6, a row driver 5 for sequentially driving gate lines GL of the liquid crystal panel 6, a controller 2 for controlling the column driver 3 and the row driver 5, and a gamma voltage generator 4 for applying a gamma voltage to the column driver 3.

In the liquid crystal panel 6, liquid crystal is injected between two glass substrates, and the gate lines GL and the data lines DL are formed on the lower glass substrate in such a manner as to be perpendicular to each other. At each intersection between the gate lines GL and the data lines DL, a thin film transistor (TFT) for selectively applying an image input from the data lines DL to a liquid crystal cell Clc is provided. To this end, the TFT has a gate terminal connected to the gate line GL and a source terminal connected to the data line DL. The drain terminal of the TFT is connected to a pixel electrode of the liquid crystal cell Clc.

The digital video card 1 converts an analog input image signal into a digital image signal suitable for the liquid crystal panel 6 and detects a synchronous signal included in the image signal. The controller 2 applies red (R), green (G) and blue (B) digital video data from the digital video card 1 to the column driver 3. Also, the controller 2 generates a dot clock Dclk and a gate start pulse GSP using horizontal/vertical synchronizing signals H and V input from the digital video card 1 to provide a timing control of the column driver 3 and the row driver 5. The dot clock Dclk is applied to the column driver 3 while the gate start pulse GSP is applied to the row driver 5.

The row driver 5 includes a shift register for responding to the gate start pulse GSP input from the controller 2 to sequentially generate a scanning pulse, and a level shifter for shifting a voltage of the scanning pulse to a voltage level suitable for driving the liquid crystal cell. Video data at the data line DL is applied to a pixel electrode of the liquid crystal cell Clc by the TFT in response to the scanning pulse input from the row driver 5.

The dot clock Dclk, along with the R, G and B digital video data from the controller 2, is input to the column driver 3. The column driver 3 latches the R, G and B digital video data in synchronization with the dot clock Dclk and corrects the latched data in accordance with a gamma voltage Vγ. Then, the column driver 3 converts data corrected by the gamma voltage Vγ into analog data and supplies it to the data line DL for each line.

As shown in FIG. 2, the column driver 3 includes a first latch 21 to which R, G and B data are input, a second latch 22, a digital to analog converter (DAC) 23 and an output buffer 24 connected, in series, between the first latch 21 and the data lines DL1 to DLn, and an address shift register 25 for assigning an address of the second latch 25.

The first latch 21 temporarily stores the R, G and B data from the controller 2 and applies the stored data to the second latch 22 every horizontal period. The second latch 22 stores data from the first latch 21 in a location indicated by address information from the address shift register 25 and supplies the stored data for one line to the DAC 23.

The DAC 23 selects a gamma voltage Vγ corresponding to data from the second latch 22 and applies it to the data lines DL1 to DLn. A detailed description as to this DAC 23 will be made in conjunction with FIG. 6 later. The output buffer 24 consists of a voltage follower connected in series to the data line DL so as to buffer data from the DAC 23 and apply the buffered data to the data lines DL1 to DLn. The output buffer 24 and the second latch 22 receive a polarity inverting signal from the controller 2 for the purpose of inverting the polarity of the video data depending on an inversion driving system, such as a dot inversion system, a line (or column) inversion system, and a frame inversion system.

The address shift register 25 generates address information for the data stored in the second latch 22 to control the second latch 22. The gamma voltage generator 4 generates a gamma voltage Vγ corresponding to a gray level value of data, in consideration of an electro-optical characteristic of the liquid crystal panel 6, and applies it to the DAC 23. The gamma voltage Vγ from the gamma voltage generator 4 is set to have a different voltage magnitude in correspondence with a gray level value selected in an expressible range as shown in FIG. 3. In FIG. 3, in the normally white mode, data having the lowest brightness is GMA1, corresponding to a voltage Vdd, and data having a relatively higher brightness corresponds to GMA2, GMA3, . . . , GMAN.

Each liquid crystal cell Clc expresses a gray level value having a specific brightness by a relative potential difference between the gamma voltage Vγ and a common voltage Vcom. More specifically, as shown in FIG. 4, an LCD with the normally white mode expresses an image at a brightness close to white when a potential difference between the gamma voltage Vγ and the common voltage Vcom is low, whereas it expresses an image at a brightness gradually closer to black as a potential difference between the gamma voltage Vγ and the common voltage Vcom becomes high. When a gamma voltage Vγ corresponding to an input image signal data expressed by a hexadecimal digit is selected, an analog voltage as shown in FIG. 5 is applied to the liquid crystal cell Clc of the liquid crystal panel 6. The gamma voltage generator 4 is classified into a positive part and a negative part to correspond to the inversion driving system. A configuration of the positive part is as shown in FIG. 6.

The negative part has a configuration substantially identical to the positive part except for the polarity of a supplied voltage.

Referring to FIG. 6, the positive part type gamma voltage generator 4 includes: a reference voltage generator 41 for generating reference voltages VH1 to VH6 each having a different voltage level in accordance with a voltage-divided resistance ratio; a buffer unit 42 connected to an output terminal of the reference voltage generator 41; and a gamma voltage output 43 connected between the buffer unit 42 and the DAC 23 to divide the reference voltage VH1 to VH6 and output gamma voltages Vγ having different voltage levels.

The reference voltage generator 41 includes a serial connection of first to sixth resistors R1 to R6 to generate six reference voltages VH1 to VH6 in accordance with a voltage-divided resistance ratio, and to apply them to the buffer unit 42. The buffer unit 42 consists of a voltage follower connected, in series, between an output terminal of the reference voltage generator 41 and the gamma voltage output 43. The buffer unit 42 stabilizes the reference voltages VH1 to VH6 and applies them to the gamma voltage output 43. The gamma voltage output 43 consists of a serial connection of 64 resistors R11 to R164. The gamma voltage output 43 sub-divides the six reference voltages VH1 to VH6 into 64 gamma voltages and applies them to the DAC 23.

The DAC 23 includes a data input 44 for receiving 6-bit data D0 to D5 from the second latch 22, and a decoder 45 connected between the data input 44 and the gamma voltage output 43. The data input 44 includes an inverter for inverting a logical value of each data bit to generate an inverted signal and a non-inverted signal of the data and to apply them to the decoder 45. The decoder 45 consists of a plurality of logical elements in an array to select any one of the 64 gamma voltages Vγ in accordance with the inverted and non-inverted data from the data input 44 and to apply the selected gamma voltage Vγ to the output buffer 24.

Nowadays, the LCD requires interchangeability with various peripheral equipment capable of displaying image signals input from a personal computer, a television, a player for an optical recording medium such as a compact disk (CD) or a digital versatile disk (DVD), or a camcoder, etc. However, the conventional driving apparatus for the LCD cannot correct a gamma voltage enough to be suitable for each image signal from the various peripheral equipment because the gamma voltage has been fixed by a predetermined voltage-divided resistance ratio. As a result in the case of displaying an image signal inputted from the peripheral equipment, the conventional LCD presents color distortion, etc., of a displayed image, depending on the type of the peripheral equipment to thereby cause a deterioration in quality of the displayed image.

Also, the conventional LCD has a problem in that, since it has a poor correlative color temperature, it cannot obtain constant chrominance co-ordinates in accordance with a value of the input data. In other words, as can be seen from the color co-ordinates of FIG. 7 that is indicated by the XYZ system defined by the Committee International Ellumination (CIE), the LCD has a serious variation in a correlative color temperature because it has a wide and irregular correlative color temperature distribution. If a variation in the correlative color temperature is serious, it becomes difficult to provide a color expression corresponding to a desired gray level value for a black and white image as well as for a color image and hence a displayed image becomes unnatural.

In FIG. 7, the horizontal axis and the vertical axis represent independent parameters x and y, respectively, when a color is displayed by the CIE co-ordinate system. The solid line indicates a color temperature of an ideal blackbody emitting a light identical to a light from a light source. In FIG. 7, "•" represents a correlative color temperature according to a gray level value of an input image. $D_{65}$ represents a standard light source corresponding to sunshine in broad daylight in which a correlative color temperature is 6504 K, whereas C represents a standard light source corresponding to average sunshine on a cloudy day in which a correlative color temperature is 6774 K. In reality, since only video data corresponding to the highest brightness in the LCD has an appropriate color temperature value, a real image is observed at a white level. However, a real image is observed at a blue color because a correlative color temperature is considerably high when a digit value of a video data is small, that is, when it is dark, whereas it is observed at a slight blue color in the case of a video data digit value having a middle brightness. As a result, since the screen is observed with a bluish color as a whole, it becomes difficult to provide a natural color display. This is caused by physical and optical characteristics of a liquid crystal. There is a limit in solving such a problem by a correction of the gamma voltage.

SUMMARY OF THE INVENTION

Accordingly, it is an object of the present invention to provide a gamma voltage and video data correcting apparatus and method in a liquid crystal display that is capable of improving a display quality of the LCD.

In order to achieve these and other objects of the invention, a gamma voltage correcting apparatus for a liquid crystal display according to one aspect of the present invention includes memory means for storing a gamma data for controlling a gamma voltage for each of at least two modes; control means for accessing the gamma data for each mode in response to an instruction from a user; and multi-channel gamma voltage generator for responding to gamma data in a mode selected by the control means to generate n gamma voltages (wherein n is an integer) having a different voltage level indicating by the gamma data in the selected mode. The gamma voltage correcting apparatus further includes a column driver for correcting the video data using the gamma voltage from the multi-channel gamma voltage generator and supplying it to the data lines.

A video data correcting apparatus for a liquid crystal display according to another aspect of the present invention includes memory means for storing a lookup table in which a color temperature correction data for correcting a color temperature characteristic of an input image is set in correspondence with a gray level value of the input image; memory control means for accessing the lookup table of the memory means in accordance with the gray level value of the input image to read out a color temperature correction data corresponding to the gray level value of the input image; and data driving means for driving the data lines using the color temperature correction data from the memory control means. The gamma voltage correcting apparatus further includes a row driver for sequentially applying a scanning pulse to the gate lines to drive the gate lines; and a timing controller for supplying the input image to the memory control means and for applying a desired timing control signal to the row driver.

A gamma voltage correcting method for a liquid crystal display according to still another aspect of the present invention the steps of storing a gamma data for controlling a gamma voltage for each of at least two modes; accessing the gamma data for each mode in response to an instruction from a user; selecting any one of the gamma data for each mode; and responding to a gamma data in the selected mode to generate n gamma voltages (wherein is an integer) having a different voltage level indicating by the gamma data in the selected mode. The gamma is set differently in accordance with each mode set in correspondence with a peripheral equipment changeable with the liquid crystal display.

A gamma voltage correcting method for a liquid crystal display according to still another aspect of the present invention the steps of providing a lookup table in which a color temperature correction data for correcting a color temperature characteristic of an input image is set in correspondence with a gray level value of the input image; accessing the lookup table in accordance with the gray level value of the input image to read out a color temperature correction data corresponding to the gray level value of the input image; and driving the data lines using the color temperature correction data. The color temperature correction data is a data measured after controlling the input image such that a color temperature of a display image on the liquid crystal display maintains approximately 6500 K.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
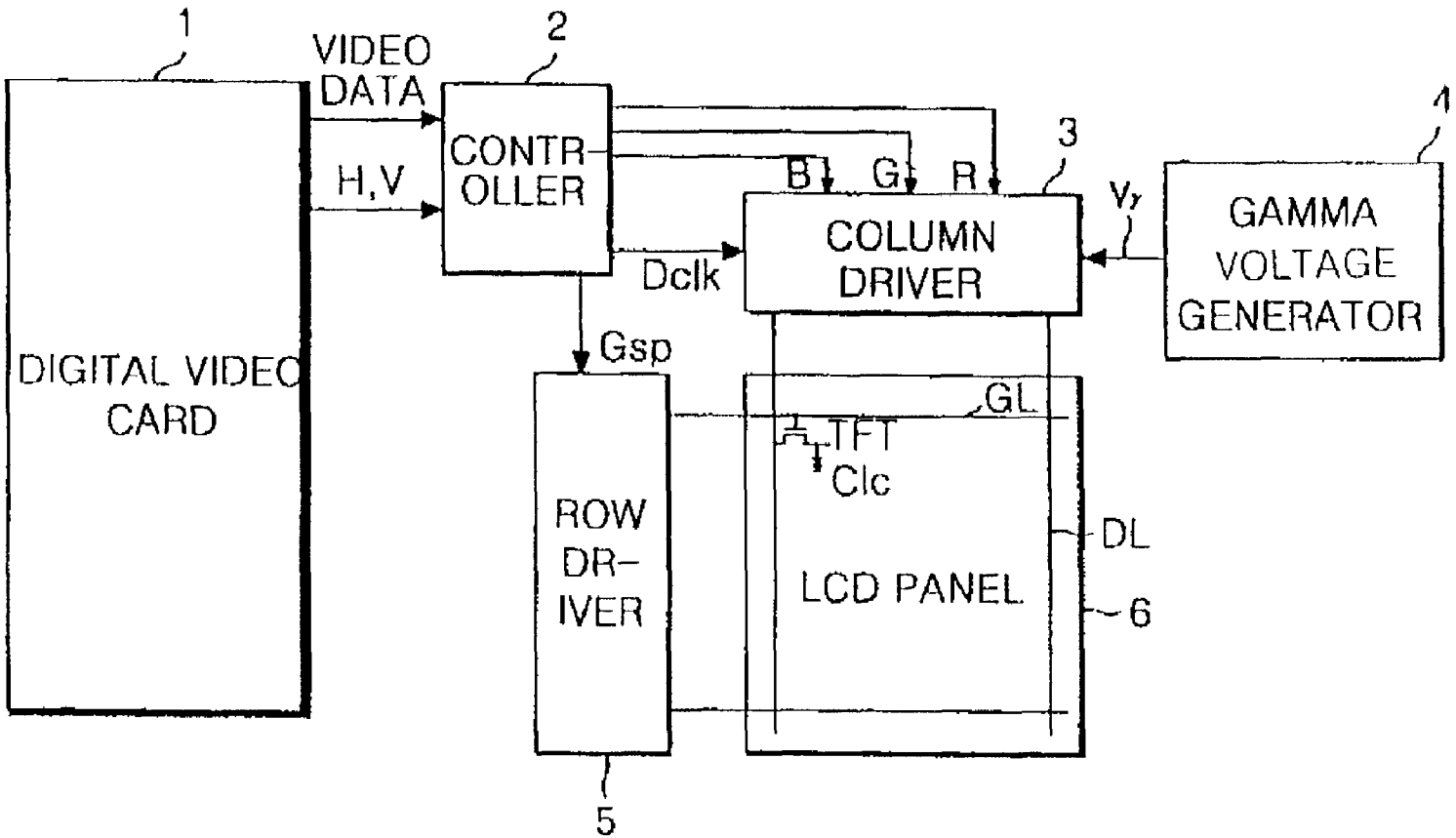
FIG. 1 CONVENTIONAL ART
FIG. 1 is a block diagram showing a configuration of a conventional liquid crystal display.
Figure 2:
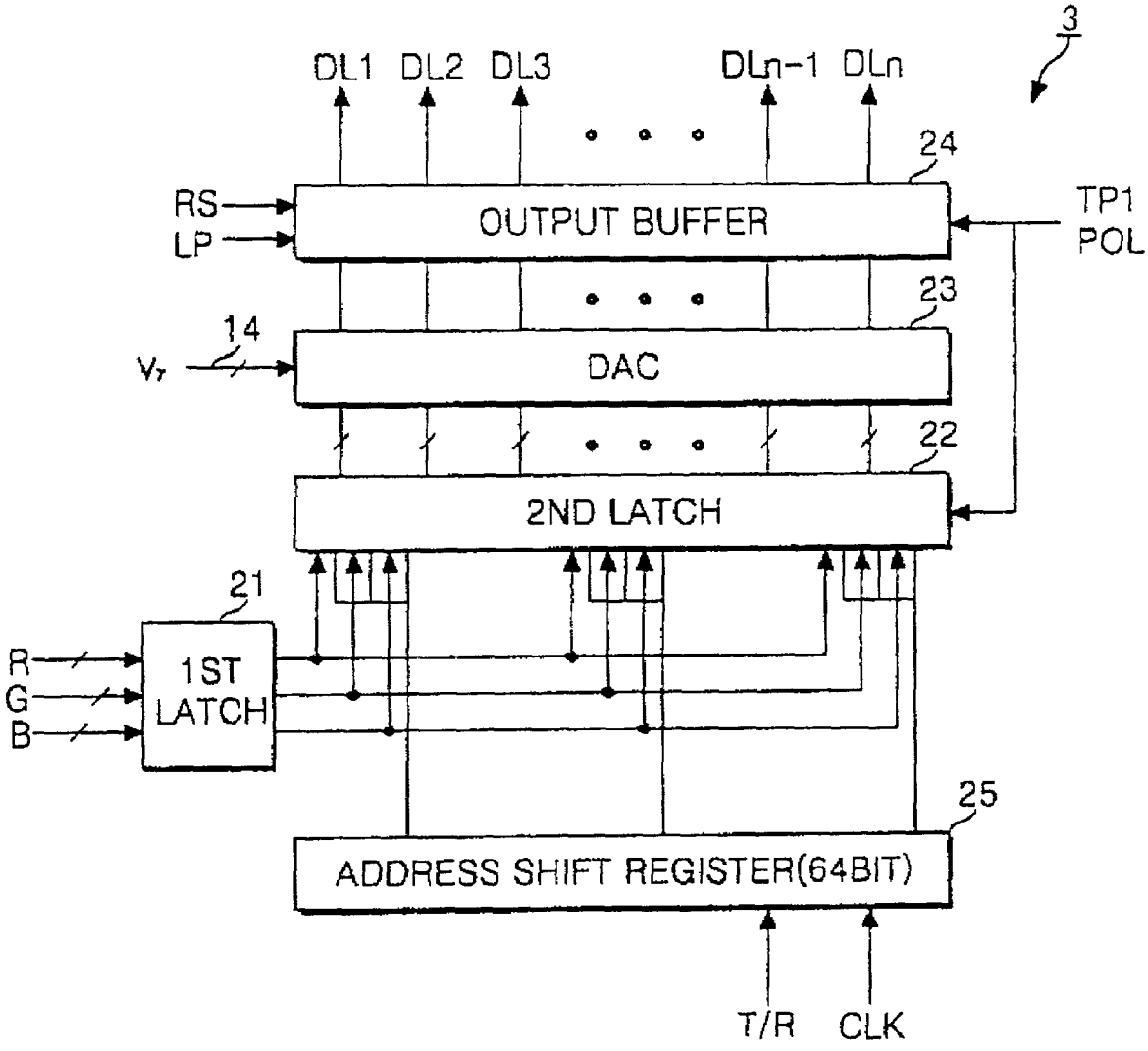
FIG.2 CONVENTIONAL ART
FIG. 2 is a detailed block diagram of the column driver shown in FIG. 1.
Figure 3:
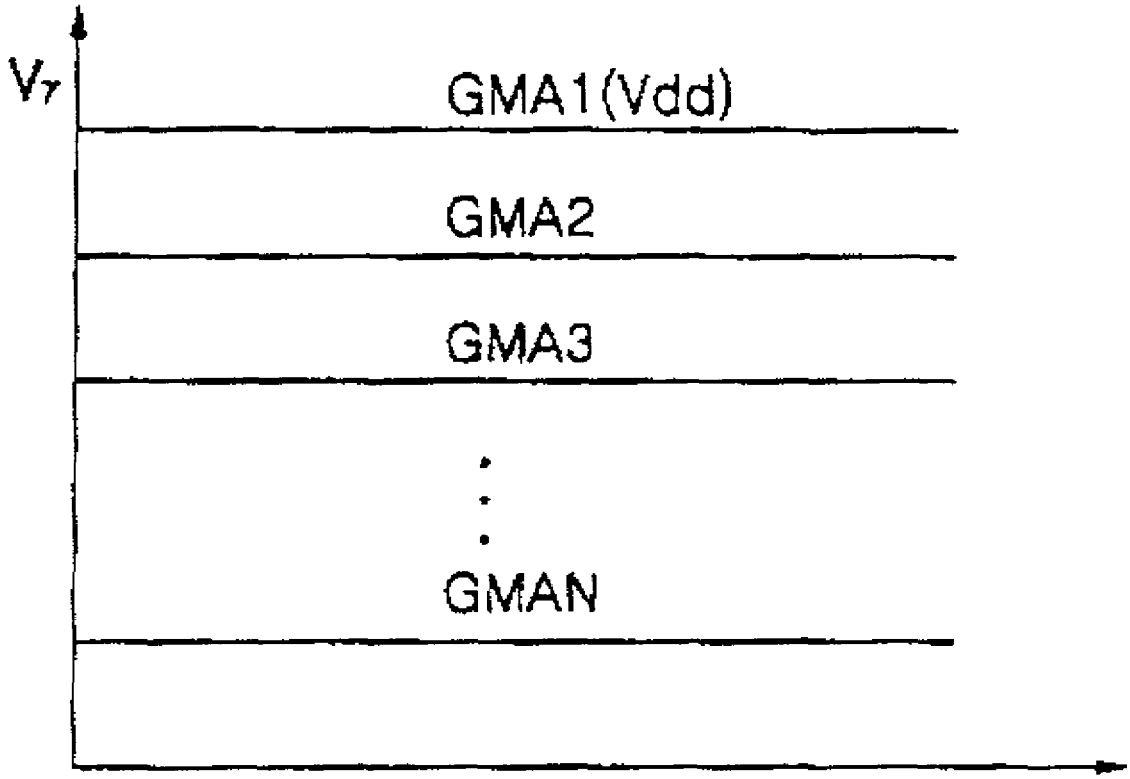
FIG. 3 CONVENTIONAL ART
FIG. 3 is a characteristic graph of a gamma voltage generated from the gamma voltage generator shown in FIG. 1.
Figure 4:
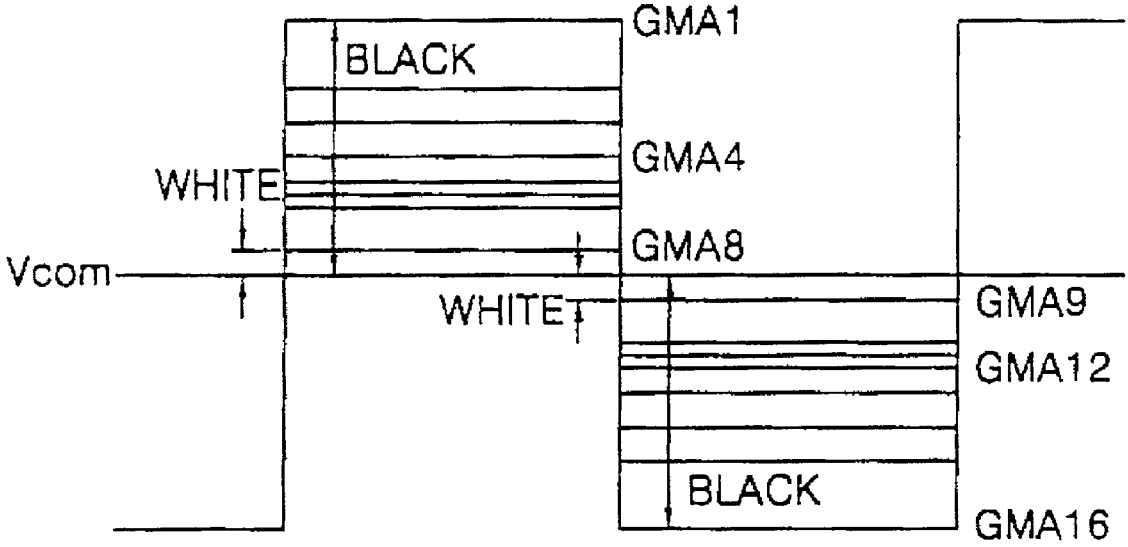
FIG. 4 CONVENTIONAL ART
FIG. 4 is a characteristic graph representing brightness corresponding to the gamma voltage.
Figure 5:
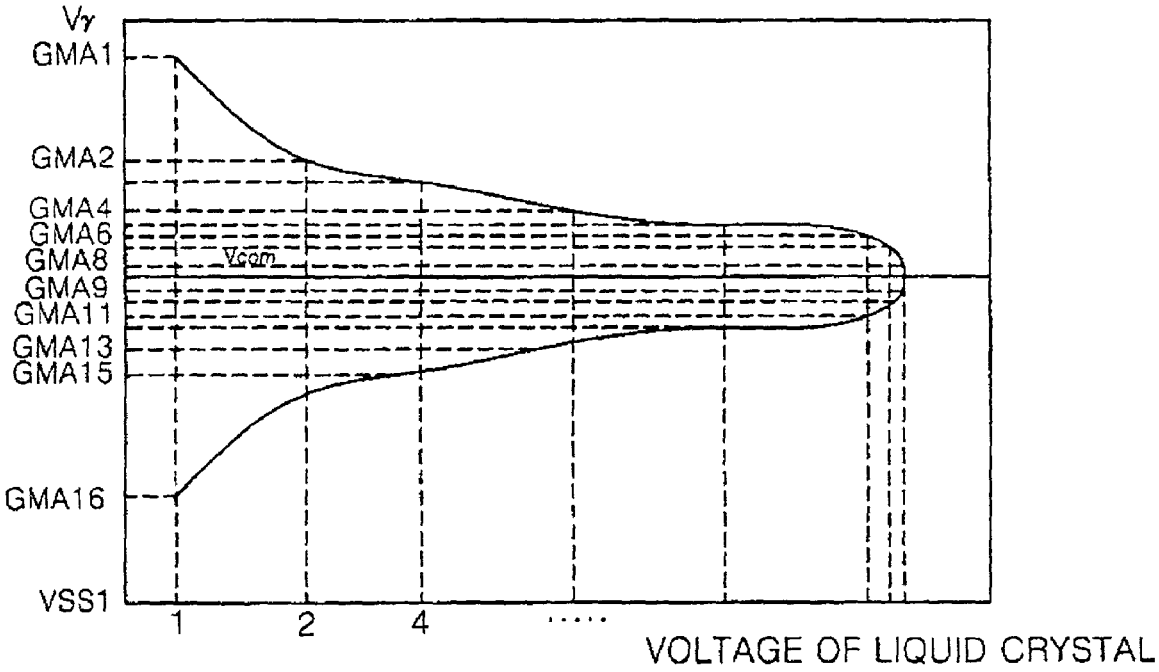
FIG. 5 CONVENTIONAL ART
FIG. 5 is a waveform diagram of a voltage applied to a liquid crystal cell by the gamma voltage.
Figure 6:
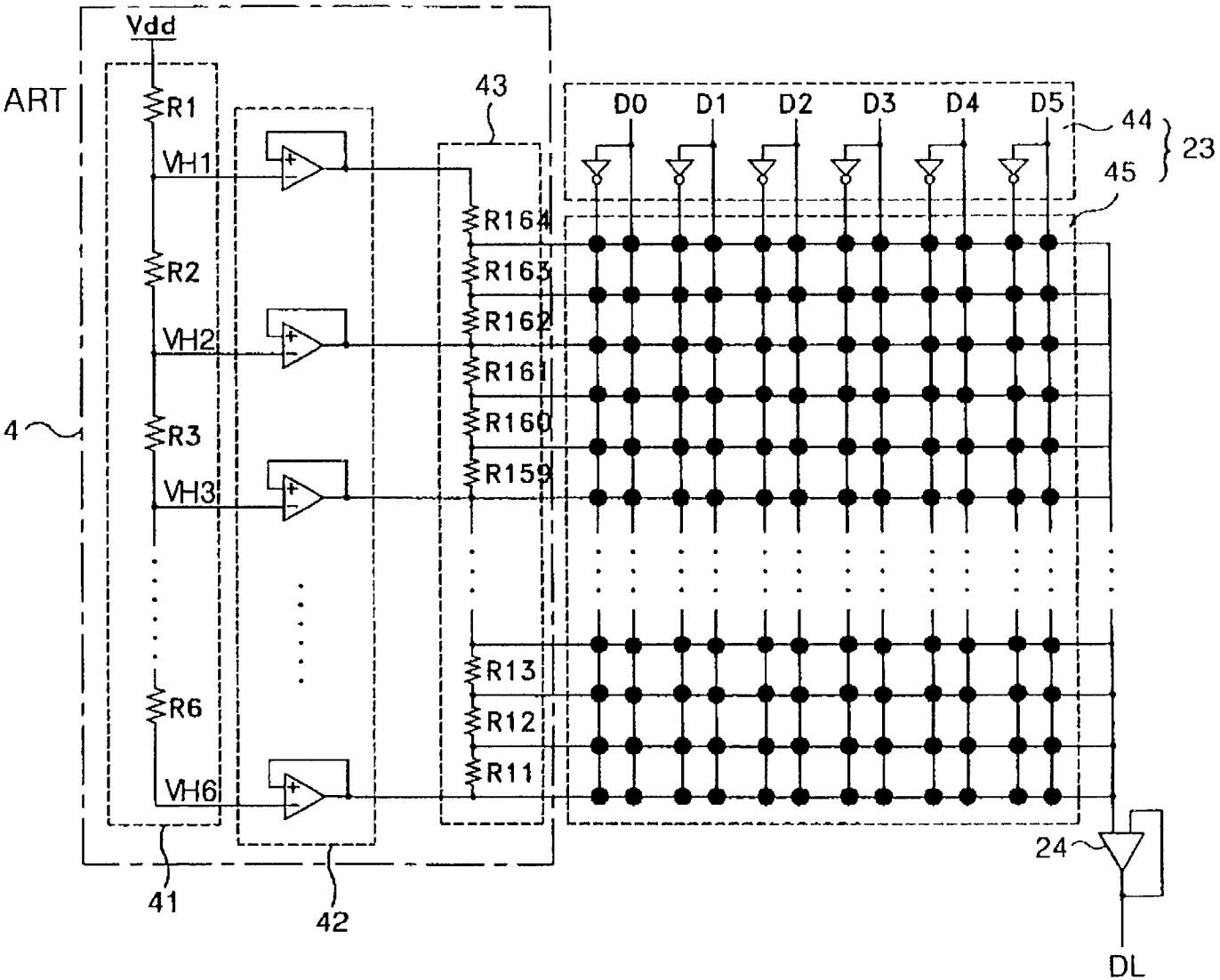
FIG.6 CONVENTIONAL ART
FIG. 6 is a detailed circuit diagram of the gamma voltage generator and the column driver shown in FIG. 1.
Figure 7:
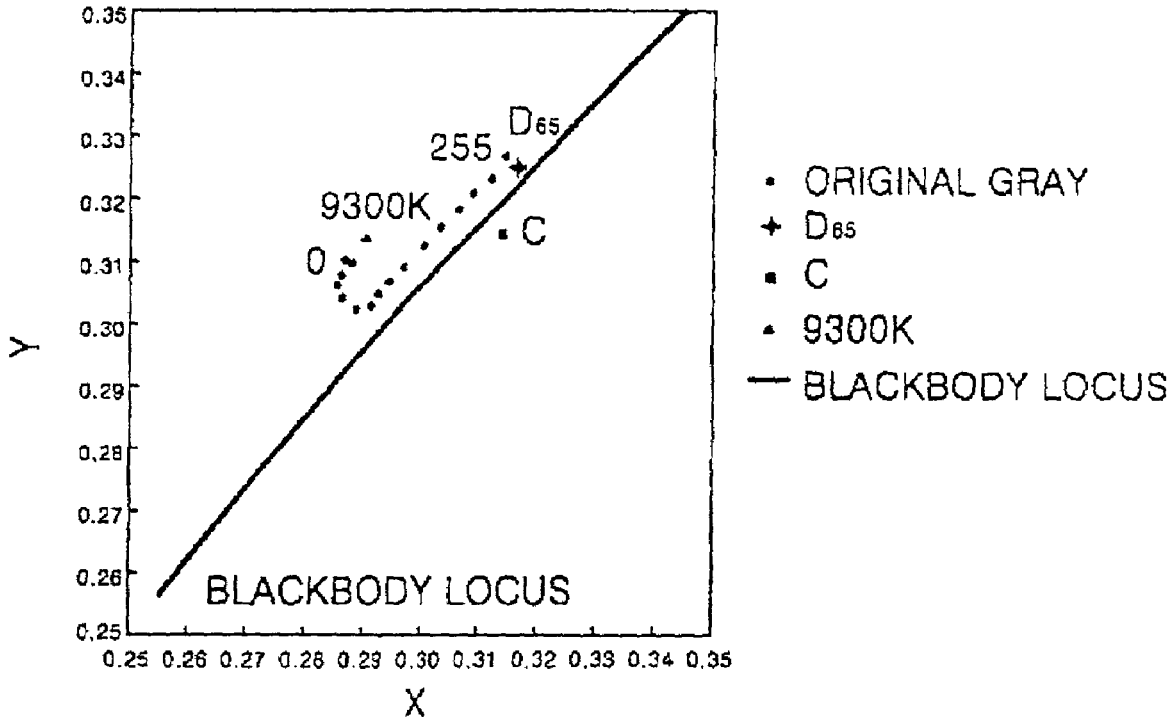
FIG. 7 CONVENTIONAL ART
FIG. 7 is a color co-ordinate graph for explaining a color distortion phenomenon in the conventional liquid crystal display.
Figure 8:
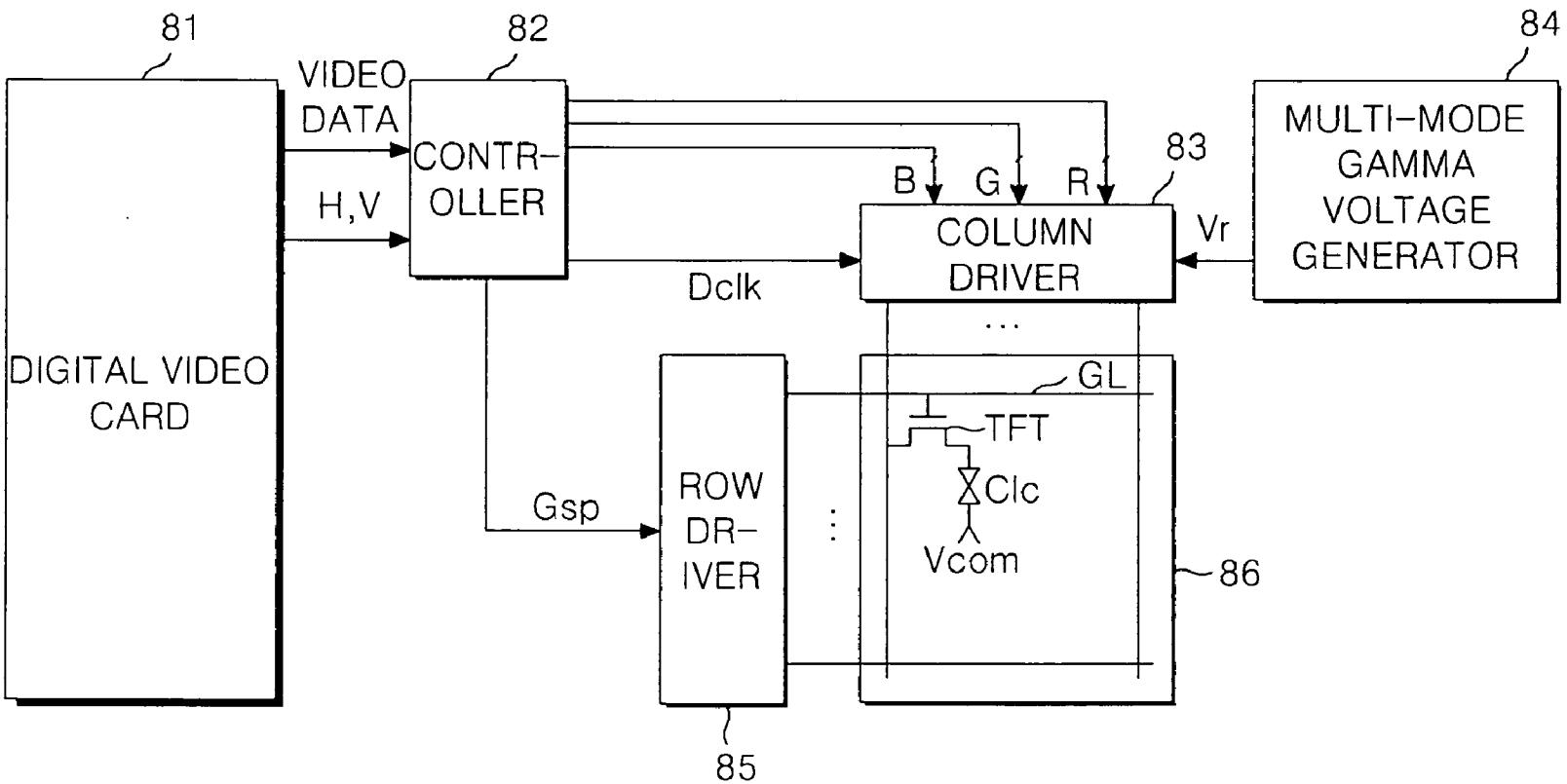
FIG. 8 is a block diagram showing a configuration of a liquid crystal display according to an embodiment of the present invention.

Referring to FIG. 8, there is shown a liquid crystal display (LCD) according to a first embodiment. The LCD includes a digital video card 81 for converting an input image signal into digital video data, a multi-mode gamma voltage generator 84 for generating a gamma voltage using multi-mode gamma data set in advance in correspondence with various peripheral equipment, a column driver 83 for supplying data to data lines DL of a liquid crystal panel 86, a row driver 85 for sequentially driving gate lines GL of the liquid crystal panel 86, and a controller 82 for controlling the column driver 83 and the row driver 85.

The multi-mode gamma voltage generator 84 stores therein gamma data in consideration of an electro-optical characteristic of a liquid crystal device so as to provide a natural display on the liquid crystal panel 86 of an original image input from the peripheral equipment, such as a personal computer, a television, an optical recording medium player or a camcoder. Also, the multi-mode gamma voltage generator 84 is connected to a user interface, for example, an on screen display key on a case, a remote control, a mouse, or a keyboard to select a specified mode gamma data in accordance with an instruction from a user. By utilizing the selected gamma data, the multi-mode gamma voltage generator 84 divides a gamma voltage into a gray level range to be displayed and applies it to the column driver 83.

A dot clock Dclk, along with red (R), green (G) and blue (B) digital video data, from the controller 82 is input to the column driver 83. The column driver 83 latches the R, G and B digital video data in synchronization with the dot clock Dclk and thereafter corrects the latched data in accordance with a gamma voltage Vγ from the gamma voltage generator 84. Further, the column driver 83 converts the data corrected by the gamma voltage Vγ into analog data to apply it to the data lines DL for each line. To this end, the column driver 83 includes a latch, a digital to analog converter (DAC), an output buffer and an address shift register.

Figure 9:
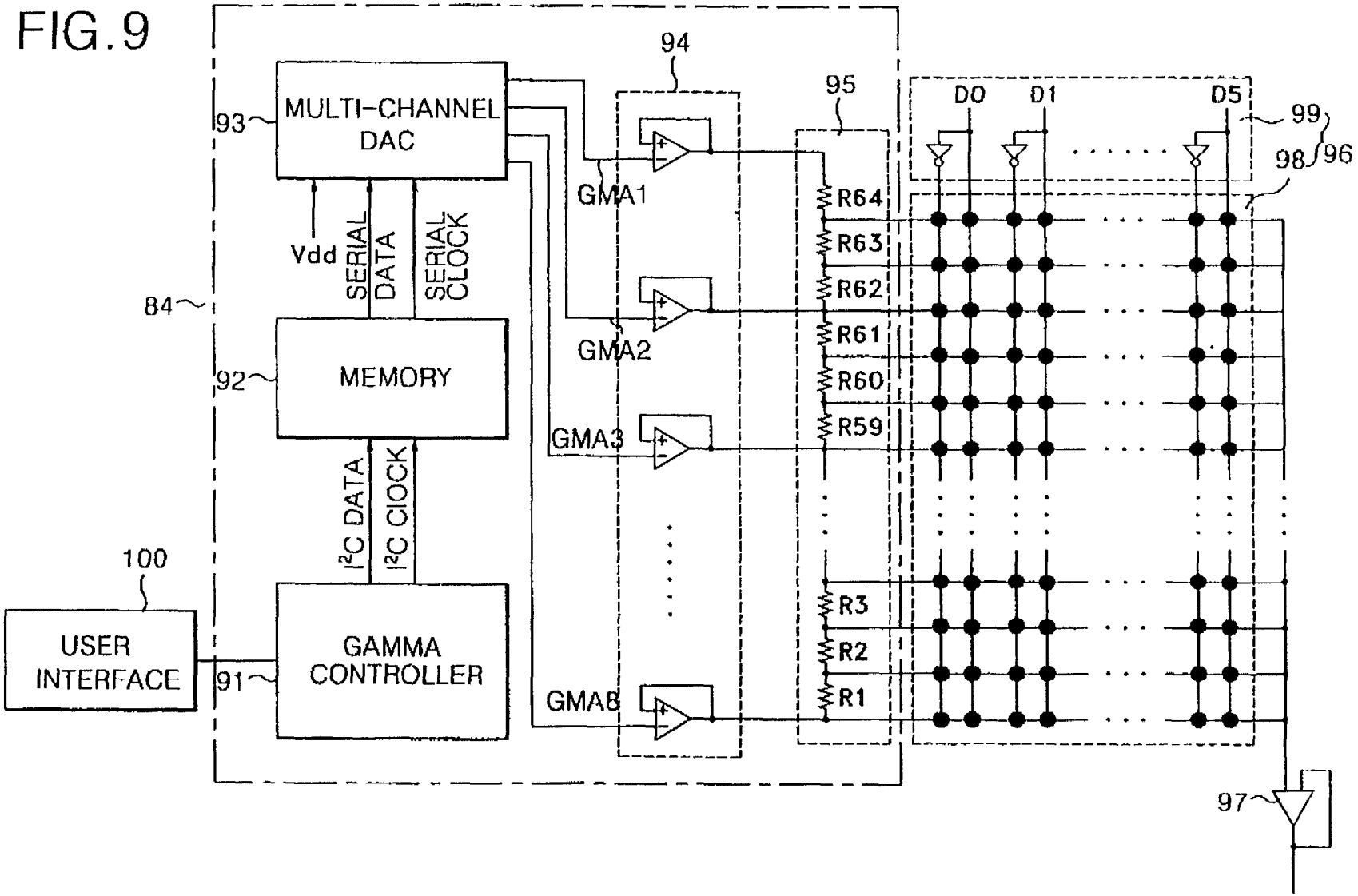
FIG. 9 is a detailed block circuit diagram of the multi-mode gamma voltage generator and the column driver shown in FIG. 8.

Referring to FIG. 9, the multi-mode gamma voltage generator 84 includes a gamma controller 91 connected to a user interface 100, and a memory 92, a multi-channel DAC and a buffer unit 94 and a gamma voltage output 95 connected between the gamma controller 91 and a DAC 96 of the column driver 83.

The gamma controller 91 is connected between the user interface 100 and the memory 92 to control the memory 92 in accordance with a user instruction from the user interface 100. To this end, the gamma controller 91 is connected to the user interface 100 by a wire or wireless system and is connected, via an $I^2C$ (for example), to the memory 92 to thereby apply $I^2C$ data interpreting the user instruction and an $I^2C$ clock to the memory 92. The gamma controller 91 is preferably implemented with a microcomputer.

The memory 92 is changeable with peripheral equipment and stored therein is a multi-mode gamma data set in consideration of a liquid crystal display characteristic. The gamma data can be experimentally determined to provide a normal picture quality on the liquid crystal panel 86 after displaying signals from the changeable peripheral equipment. Such gamma data is input to the multi-channel DAC 93 as a desired bit (e.g., 6-bit) serial input data to indicate a gamma reference voltage for each mode. The memory 92 is preferably implemented with EEPROM or EPROM, etc.

The multi-channel DAC 93 is connected between the memory 92 and the buffer unit 94 to interpret serial gamma data inputted from the memory 92, thereby outputting eight gamma reference voltages GMA1 to GMA8 indicated by the serial gamma data. The buffer unit 94 consists of a voltage follower connected, in series, between an output terminal of the multi-channel DAC 93 and the gamma voltage output 95. The buffer unit 94 stabilizes the eight gamma reference voltages GMA1 to GMA8 and applies them to the gamma voltage output 95. The inputs/outputs of the memory 92 and the multi-channel DAC 93 are synchronized with each other by clock signals, $I^2C$ clock and Serial Clock.

The gamma voltage output 95 consists of a serial connection of 64 resistors R1 to R64. The gamma voltage output 95 sub-divides the eight gamma reference voltages GMA1 to GMA8 into 64 gamma voltages and applies them to the DAC 96. The DAC 96 includes a data input 99 receiving 6-bit data D0 to D5 from a latch of the column driver (not shown), and a decoder 98 connected between the data input 99 and the gamma voltage output 95. The data input 99 includes an inverter for inverting a logical value of each data bit so as to generate an inverted signal and a non-inverted signal of the data and to apply them to the decoder 98. The decoder 98 consists of a plurality of logical elements in an array so as to select any one of the 64 gamma voltages Vγ in accordance with the inverted and non-inverted data from the data input 99 and to apply the selected gamma voltage Vγ to the output buffer 97.

Figure 10:
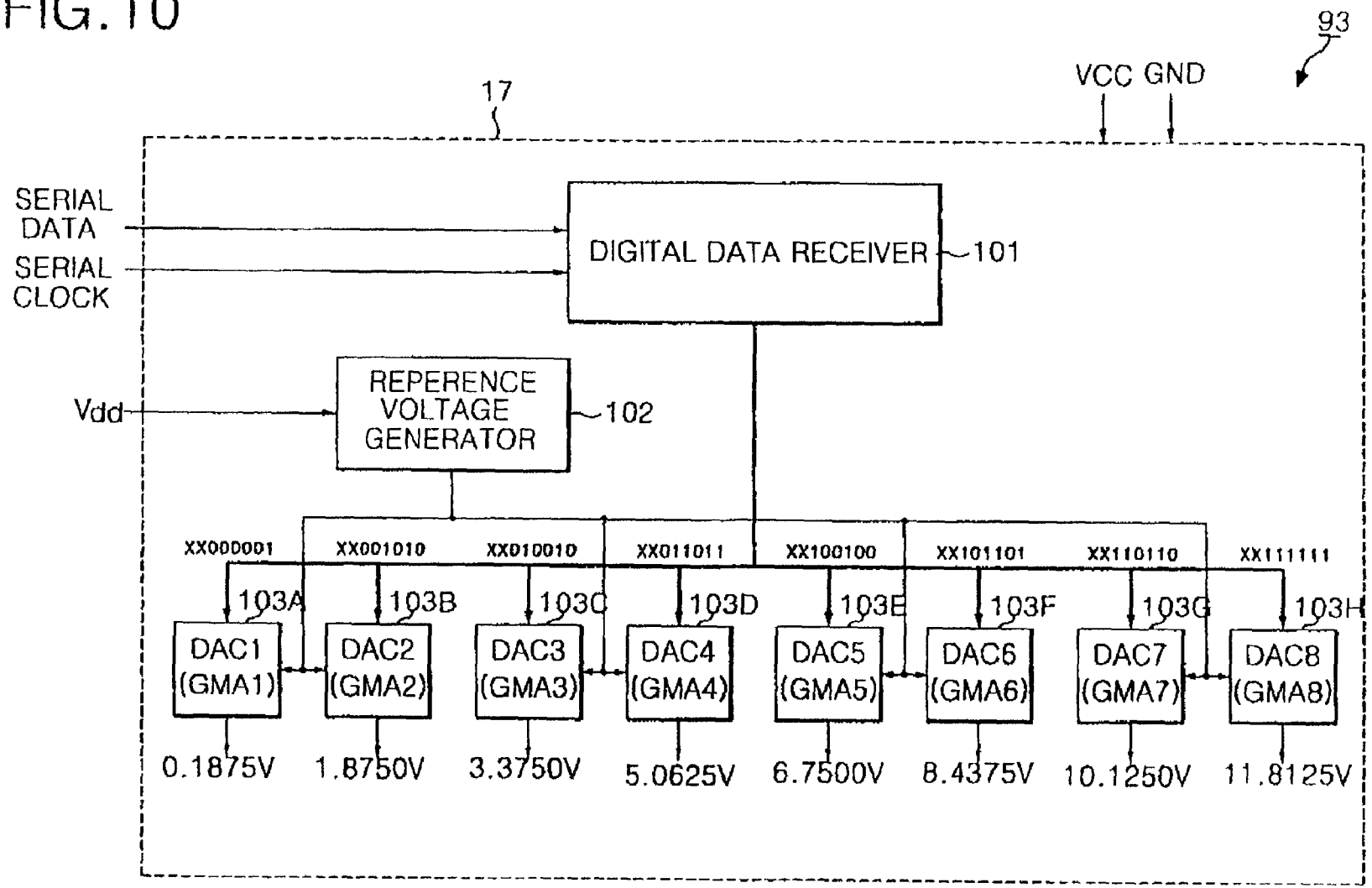
FIG. 10 is a detailed block diagram of the multi-channel digital to analog converter shown in FIG. 9.

Referring to FIG. 10, the multi-channel DAC 93 is supplied with a driving voltage Vcc and a ground voltage GND, and includes: a data receiver 101 to which a serial gamma data signal, Serial Data, and a clock signal, Serial Clock, are input from the memory 92; a reference voltage generator 102 to which a supply voltage Vdd is input; and a plurality of digital to analog converters (DACs) commonly connected to the data receiver 101 and the reference voltage generator 102.

The data receiver 101 applies gamma data from the memory 92 commonly to a plurality of DACs 103A to 103H. The reference voltage generator 102 divides the supply voltage Vdd to generate reference voltages having a different voltage level for each mode, and applies the reference voltages to the DACs 103A to 103H.

Figure 11:
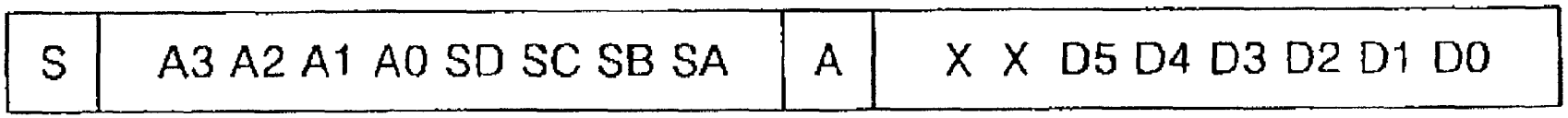
FIG. 11 illustrates a signal format of gamma data generated from the multi-mode gamma voltage generator shown in FIG. 8.

As shown in FIG. 11, the gamma data inputted to the DACs 103A to 103H is an 18-bit data packet including one start bit S, four address bits A0 to A3, four sub-address bits SA to SD, one data header bit A, and six gamma data bits D0 to D5. The start bit S indicates a start of the data packet. The address bits A0 to A3 assign each of the DACs 103A /to 103H, while the sub-address bits SA to SD assign each address in the DACs 103A to 103H. The header bit A indicates an initiation of the gamma data bits D0 to D5. The DACs 103A to 103H interpret serial gamma data from the data receiver 101 and output eight gamma reference voltages GMA1 to GMA8 assigned by the gamma data.

An example of the gamma reference voltages GMA1 to GMA8 for each mode, Modes A to D, output from the DACs 103A to 103H is given by the following table:

TABLE 1

| Mode Gamma | Mode A | Mode B | Mode C | Mode D |
|---|---|---|---|---|
| GMA 1 | 0.1875 | 0.3750 | 0.5625 | 0.7500 |
| GMA 2 | 1.8750 | 2.0625 | 2.2500 | 2.4375 |
| GMA 3 | 3.3750 | 3.5625 | 3.7500 | 3.9375 |
| GMA 4 | 5.0625 | 5.2500 | 5.4375 | 5.6250 |
| GMA 5 | 6.7500 | 6.9375 | 7.1250 | 7.3125 |
| GMA 6 | 8.4375 | 8.6250 | 8.8125 | 9.0000 |
| GMA 7 | 10.1250 | 10.3125 | 10.5000 | 10.6875 |
| GMA 8 | 11.8125 | 11.6250 | 11.4375 | 11.2500 |

As seen from Table 1 and FIG. 10, the DACs 103A to 103H output specified mode gamma reference voltages GMA1 to GMA8 in accordance with a logical value of the gamma data. In the case of outputting a gamma reference voltage in the Mode A, the first DAC 103A responds to a gamma data '000001' to select 0.1 875 V in the reference voltages from the reference voltage generator 102 while the second to eighth DACs 103B to 103H output other gamma reference voltages GMA2 and GMA8 in the Mode A, respectively.

The gamma reference voltages GMA1 to GMA8 selected for each mode A to D in this manner are divided into 64 gamma voltages by means of the gamma voltage output 95. The gamma voltages in the Mode A are given by the following tables 2-1 and 2-2:

TABLE 2-1

| Gamma Data | DAC Output | DAC Output(V) when Vref = 12 V |
|---|---|---|
| 0 0 0 0 0 0 | Vss | 0.0000 |
| 0 0 0 0 0 1 | Vref/64 | 0.1875 |
| 0 0 0 0 1 0 | 2Vref/64 | 0.3750 |
| 0 0 0 0 1 1 | 3Vref/64 | 0.5625 |
| 0 0 0 1 0 0 | 4Vref/64 | 0.7500 |
| 0 0 0 1 0 1 | 5Vref/64 | 0.9375 |
| 0 0 0 1 1 0 | 6Vref/64 | 1.1250 |
| 0 0 0 1 1 1 | 7Vref/64 | 1.3125 |
| 0 0 1 0 0 0 | 8Vref/64 | 1.5000 |
| 0 0 1 0 0 1 | 9Vref/64 | 1.6875 |
| 0 0 1 0 1 0 | 10Vref/64 | 1.8750 |
| 0 0 1 0 1 1 | 11Vref/64 | 2.0625 |
| 0 0 1 1 0 0 | 12Vref/64 | 2.2500 |
| 0 0 1 1 0 1 | 13Vref/64 | 2.4375 |
| 0 0 1 1 1 0 | 14Vref/64 | 2.6250 |
| 0 0 1 1 1 1 | 15Vref/64 | 2.8125 |
| 0 1 0 0 0 0 | 16Vref/64 | 3.0000 |
| 0 1 0 0 0 1 | 17Vref/64 | 3.1875 |
| 0 1 0 0 1 0 | 18Vref/64 | 3.3750 |
| 0 1 0 0 1 1 | 19Vref/64 | 3.5625 |
| 0 1 0 1 0 0 | 20Vref/64 | 3.7500 |
| 0 1 0 1 0 1 | 21Vref/64 | 3.9375 |
| 0 1 0 1 1 0 | 22Vref/64 | 4.1250 |
| 0 1 0 1 1 1 | 23Vref/64 | 4.3125 |
| 0 1 1 0 0 0 | 24Vref/64 | 4.5000 |

TABLE 2-1-continued

| Gamma Data | DAC Output | DAC Output(V) when Vref = 12 V |
|---|---|---|
| 0 1 1 0 0 1 | 25Vref/64 | 4.6875 |
| 0 1 1 0 1 0 | 26Vref/64 | 4.8750 |
| 0 1 1 0 1 1 | 27Vref/64 | 5.0625 |
| 0 1 1 1 0 0 | 28Vref/64 | 5.2500 |
| 0 1 1 1 0 1 | 29Vref/64 | 5.4375 |
| 0 1 1 1 1 0 | 30Vref/64 | 5.6250 |
| 0 1 1 1 1 1 | 31Vref/64 | 5.8125 |
| 1 0 0 0 0 0 | 32Vref/64 | 6.0000 |
| 1 0 0 0 0 1 | 33Vref/64 | 6.1875 |
| 1 0 0 0 1 0 | 34Vref/64 | 6.3750 |
| 1 0 0 0 1 1 | 35Vref/64 | 6.5625 |
| 1 0 0 1 0 0 | 36Vref/64 | 6.7500 |
| 1 0 0 1 0 1 | 37Vref/64 | 6.9375 |
| 1 0 0 1 1 0 | 38Vref/64 | 7.1250 |
| 1 0 0 1 1 1 | 39Vref/64 | 7.3125 |
| 1 0 1 0 0 0 | 40Vref/64 | 7.5000 |
| 1 0 1 0 0 1 | 41Vref/64 | 7.6875 |
| 1 0 1 0 1 0 | 42Vref/64 | 7.8750 |
| 1 0 1 0 1 1 | 43Vref/64 | 8.0625 |
| 1 0 1 1 0 0 | 44Vref/64 | 8.2500 |
| 1 0 1 1 0 1 | 45Vref/64 | 8.4375 |
| 1 0 1 1 1 0 | 46Vref/64 | 8.6250 |
| 1 0 1 1 1 1 | 47Vret/64 | 8.8125 |
| 1 1 0 0 0 0 | 48Vref/64 | 9.0000 |
| 1 1 0 0 0 1 | 49Vref/64 | 9.1875 |
| 1 1 0 0 1 0 | 50Vref/64 | 9.3750 |
| 1 1 0 0 1 1 | 51Vref/64 | 9.5625 |
| 1 1 0 1 0 0 | 52Vref/64 | 9.7500 |
| 1 1 0 1 0 1 | 53Vref/64 | 9.9375 |
| 1 1 0 1 1 0 | 54Vref/64 | 10.1250 |
| 1 1 0 1 1 1 | 55Vref/64 | 10.3125 |
| 1 1 1 0 0 0 | 56Vref/64 | 10.4500 |
| 1 1 1 0 0 1 | 57Vref/64 | 10.6875 |
| 1 1 1 0 1 0 | 58Vref/64 | 10.8750 |
| 1 1 1 0 1 1 | 59Vref/64 | 11.0625 |
| 1 1 1 1 0 0 | 60Vref/64 | 11.2500 |
| 1 1 1 1 0 1 | 61Vref/64 | 11.4375 |
| 1 1 1 1 1 0 | 62Vref/64 | 11.6250 |
| 1 1 1 1 1 1 | 64Vref/64 | 11.8125 |

Figure 12:
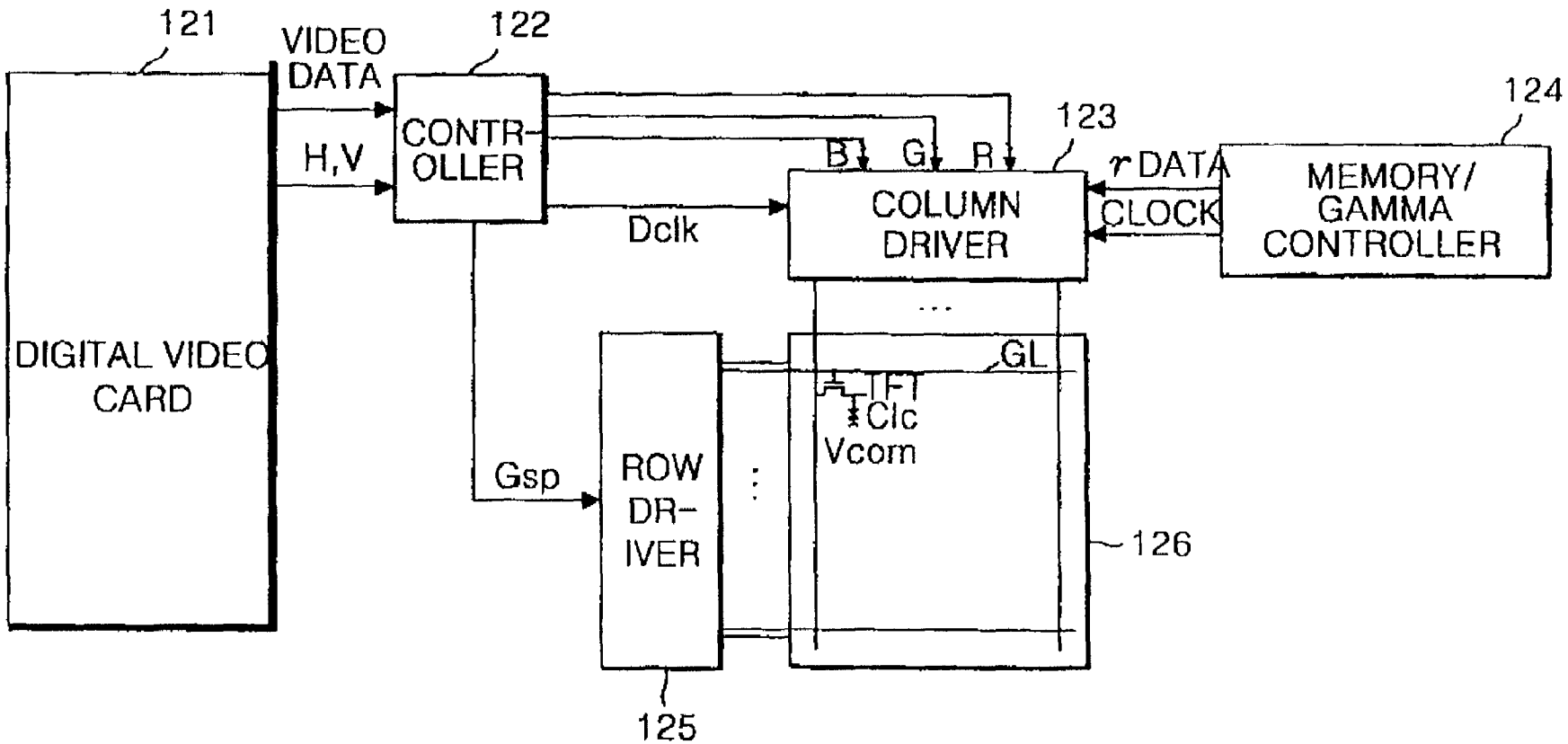
FIG. 12 is a block diagram showing a configuration of a liquid crystal display according to a second embodiment of the present invention.

Referring now to FIG. 12, there is shown an LCD according to a second embodiment. The LCD includes a digital video card 121 for converting an input image signal into a digital video data, a memory/gamma controller 124 for applying to a column driver 123 multi-mode gamma data "γData" preset in advance in correspondence with various peripheral equipment, a row driver 85 for sequentially driving gate lines GL of a liquid crystal panel 126, and a controller 122 for controlling the column driver 123 and the row driver 125.

The memory/gamma controller 124 is stored with multi-mode gamma data γ Data in consideration of an electro-optical characteristic of a liquid crystal device so as to provide a natural display of an original image inputted from the peripheral equipment, such as a personal computer, a television, an optical recording medium player or a cam-coder, on the liquid crystal panel 126. Also, the memory/gamma controller 124 is connected to a user interface to select a specified mode gamma data γ Data in accordance with an instruction from a user. The gamma data γ Data selected in this manner is input to the column driver 123. The gamma data γ Data and a clock signal Clock are delivered, preferably via an $I^2C$ bus line, to the column driver 123.

The column driver 123 receives a dot clock Dclk, along with red (R), green (G) and blue (B) digital video data, from the controller 122 and, at the same time, receives the gamma data γ Data and the clock signal Clock from the memory/gamma controller 124. The column driver 123 latches the R, G and B digital video data in synchronization with the dot clock Dclk and thereafter generates a gamma voltage in the Mode A to D selected by the gamma data γ Data using the latched data. The gamma voltage generated from the column driver 123 is selected in accordance with a brightness of the video data to be applied to the data lines DL of the liquid crystal panel 126. To this end, the column driver 123 includes a latch, a digital to analog converter (DAC), an output buffer and an address shift register to process data from the controller 122. Further, the column driver includes a circuit for responding to the gamma data γ Data to generate a gamma voltage.

Figure 13:
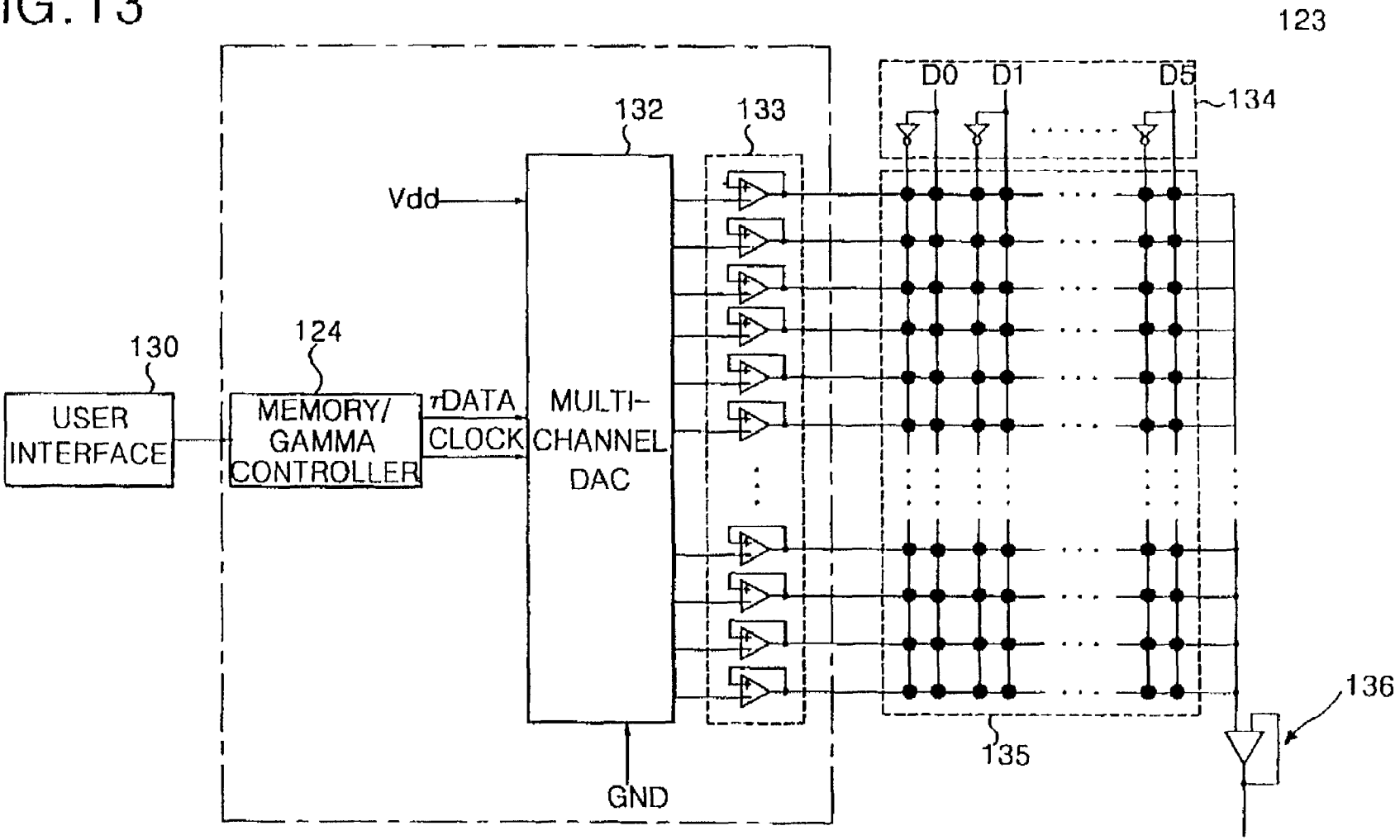
FIG. 13 is a detailed block circuit diagram of the memory/gamma controller and the column driver shown in FIG. 12.

Referring to FIG. 13, the column driver 123 includes a multi-channel DAC 132 for receiving the gamma data γ Data and the clock signal Clock from the memory/gamma controller 124, a data input 134 for receiving data from a latch (not shown), a buffer unit 133 and a decoder 135 connected between the data input 134 and the multi-channel DAC 132, and an output buffer 136 connected between the decoder 135 and the data lines DL of the liquid crystal panel 126.

The memory/gamma controller 124 is connected between a user interface 130 and the column driver 123 to output the gamma data γ Data in the specified modes, Mode A to Mode D, along with the clock signal Clock in accordance with a user instruction from the user interface 130. To this end, the memory/gamma controller 124 is gamma data having logical values set in response to a plurality of modes corresponding to the peripheral equipment interchangeable with the LCD. The memory/gamma controller 124 is integrated into a single chip in which the gamma controller 91 in FIG. 9 is integrated with the memory 92 in FIG. 9.

The multi-channel DAC 132 is provided with: a plurality of DACs for dividing a supply voltage Vdd to generate gamma reference voltages included in each mode, Mode A to D; DACs for selecting gamma reference voltages in accordance with a logical value of the gamma data γ Data; and DACs for dividing gamma reference voltages selected for each mode, Modes A to D, to generate 64 gamma voltages. Accordingly, since the multi-channel DAC 132 uses the above-mentioned DACs so as to generate gamma voltages selected for each mode, it does not require voltage-dividing resistors.

The buffer unit 133 consists of a voltage follower connected, in series, between an output terminal of the multi-channel DAC 132 and the decoder 135. The buffer unit 133 stabilizes the 64 gamma voltages selected for each mode and applies them to the decoder 135. The data input 134 includes an inverter for inverting a logical value of each data bit so as to generate an inverted signal and a non-inverted signal of the data and to apply them to the decoder 135. The decoder 135 consists of a plurality of logical elements in an array so as to select any one of the 64 gamma voltages in accordance with the inverted and non-inverted data from the data input 99 and to apply the selected gamma voltage to the output buffer 136. The multi-channel DAC 132 and the buffer unit 133 and the data input 134, the decoder 135 and the output buffer are integrated into a single chip within the column driver 123.

Figure 14:
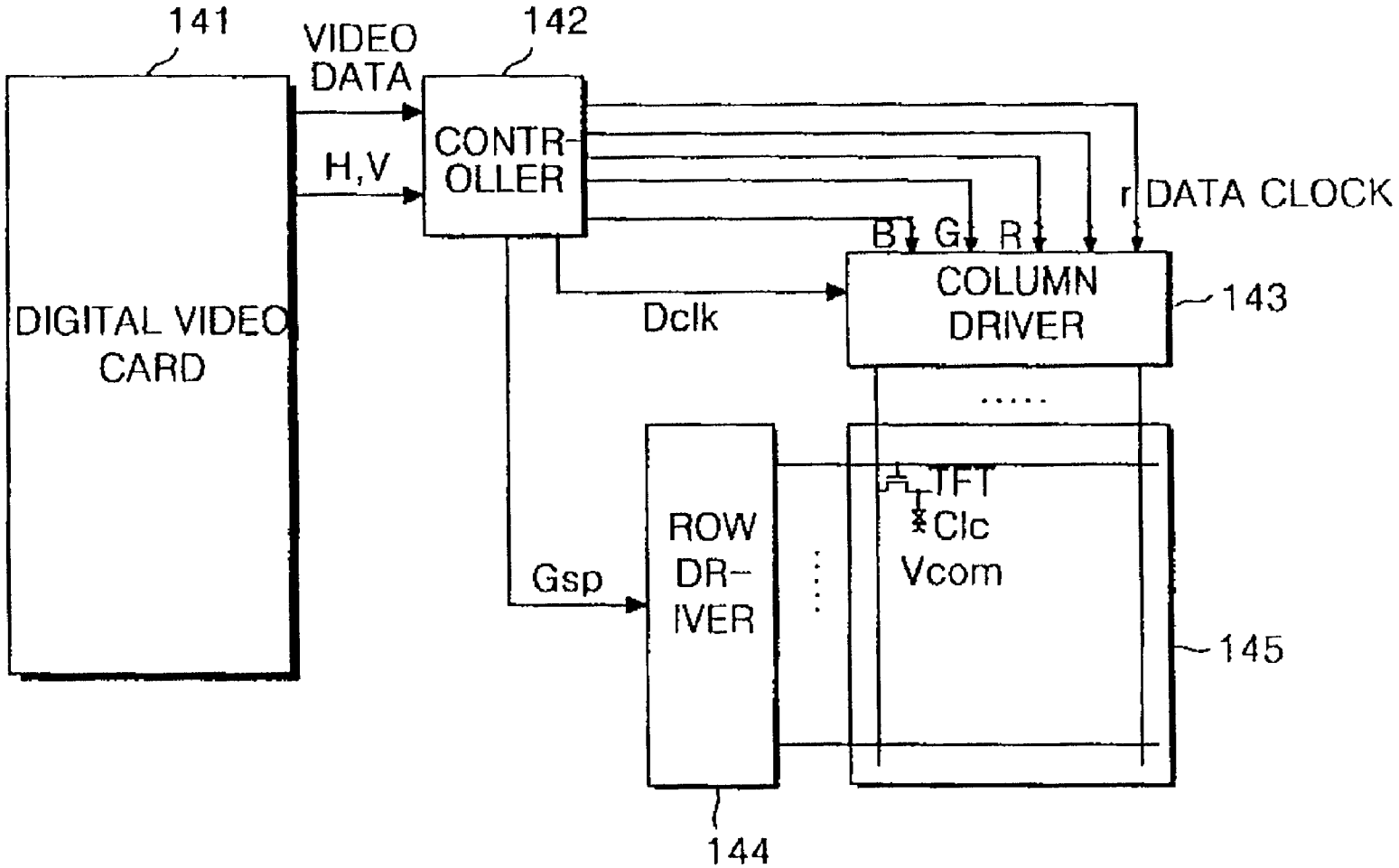
FIG. 14 is a block diagram showing a configuration of a liquid crystal display according to a third embodiment of the present invention.

Referring to FIG. 14, there is shown an LCD according to a third embodiment. The LCD includes a digital video card 141 for converting an input image signal into digital video data, a timing/gamma controller 142 for applying multi-mode gamma data γ Data and R, G and B data preset in advance in correspondence with various peripheral equipment to a column driver 143, and a row driver 144 for sequentially driving gate lines GL of a liquid crystal panel 145.

The timing/gamma controller 142 supplies R, G and B digital video data from the digital video card 141 and applies a gate start pulse GSP to the row driver 144. Also, the timing/gamma controller 142 applies a timing signal generated by horizontal/vertical signals H and V input from the digital video card 141 to the column driver 143 and the row driver 144. The timing/gamma controller 142 is stored with multi-mode gamma data "γ Data" in consideration of an electro-optical characteristic of a liquid crystal device so as to provide a natural display on the liquid crystal panel 126 of an original image input from the peripheral equipment, such as a personal computer, a television, an optical recording medium player or a camcoder. Further, the timing/gamma controller 142 is connected to a user interface to select a specified mode gamma data γ Data in accordance with an instruction from a user. The gamma data γ Data selected in this manner is input to the column driver 143. The gamma data γ Data and clock signal Clock are delivered, preferably bus line, to the column driver 143. To this end, the timing/gamma controller 142 is integrated into a single chip incorporating the gamma controller 91 and the memory 92 in FIG. 9 and the controller 122 in FIG. 12.

The column driver 143 receives a dot clock Dclk, along with red (R), green (G) and blue (B) digital video data, from the timing/gamma controller 142 and, at the same time, receives the gamma data γ Data and the clock signal Clock from the timing/gamma controller 142. The column driver 143 latches the R, G and B digital video data in synchronization with the dot clock Dclk and thereafter generates a gamma voltage in the Mode A to D selected by the gamma data γ Data using the latched data. The gamma voltage generated from the column driver 143 is selected in accordance with a brightness of the video data to be applied to the data lines DL of the liquid crystal panel 145. To this end, the column driver 143 includes a latch, a digital to analog converter (DAC), an output buffer and an address shift register so as to process data from the timing/gamma controller 142. Further, the column driver 143 includes a circuit for responding to the gamma data γ Data to generate a gamma voltage.

Figure 15:
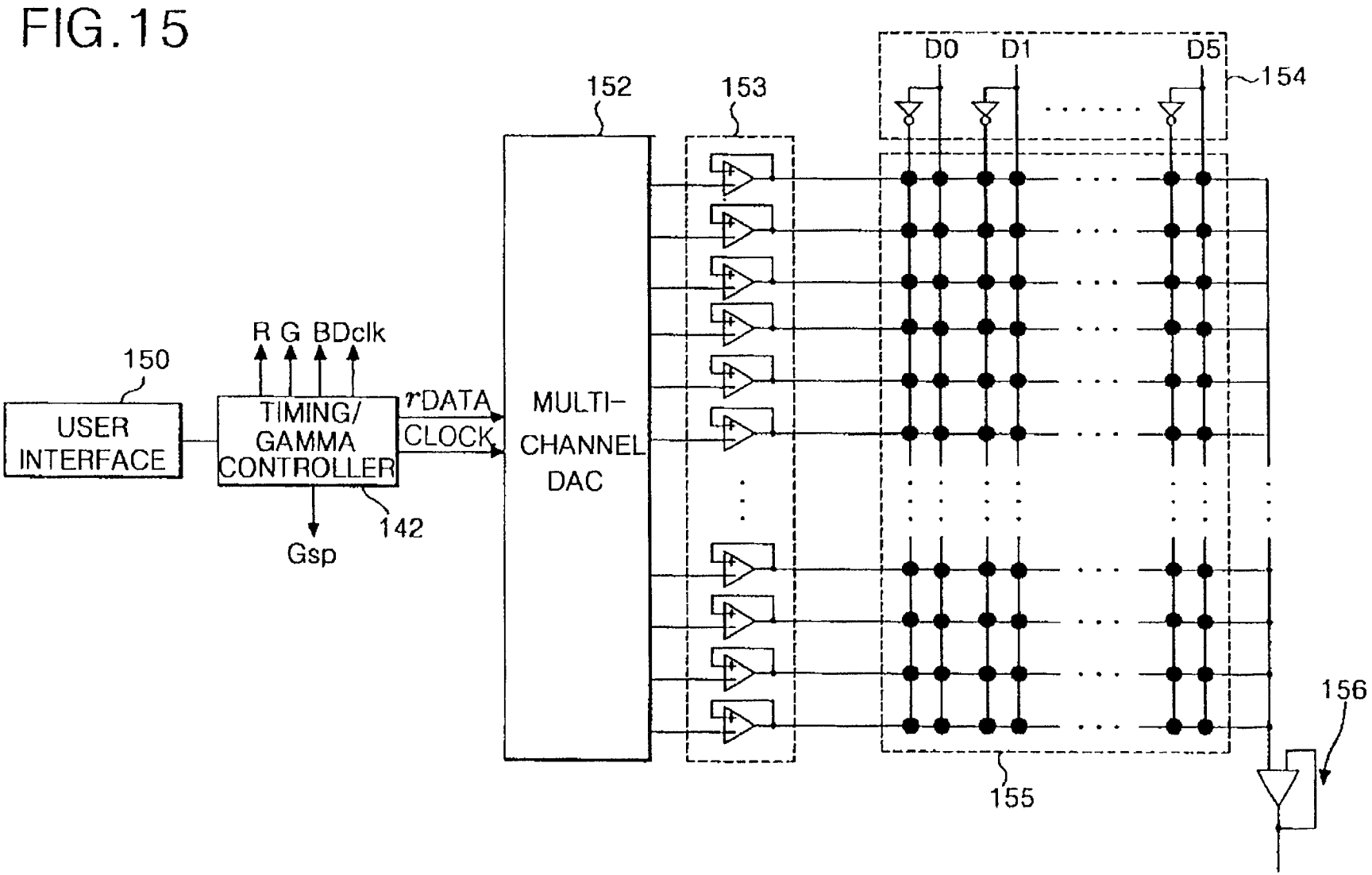
FIG. 15 is a detailed block circuit diagram of the timing/gamma controller and the column driver shown in FIG. 14.

Referring to FIG. 15, the column driver 143 includes a multi-channel DAC 152 for receiving the gamma data γ Data and the clock signal Clock from the timing/gamma controller 142, a data input 154 for receiving data from a latch (not shown), a buffer unit 153 and a decoder 155 connected between the data input 154 and the multi-channel DAC 152, and an output buffer 156 connected between the decoder 155 and the data lines DL of the liquid crystal panel 145.

The multi-channel DAC 152 of the column driver 143 is connected between the timing/gamma controller 142 and the buffer unit 153 to interpret the gamma data γ Data input from the timing/gamma controller 142, thereby outputting 64 gamma voltages corresponding to the modes, Mode A to D, indicated by the gamma data γ Data. The multi-channel DAC 152 is provided with: a plurality of DACs for dividing a supply voltage Vdd to generate gamma reference voltages included in each mode, Mode A to D; DACs for selecting gamma reference voltages in accordance with a logical value of the gamma data γ Data, and DACs for dividing gamma reference voltages selected for each mode, Mode A to D, to generate 64 gamma voltages. Accordingly, since the multi-channel DAC 152 use the above DACs so as to generate gamma voltages selected for each mode, it does not require voltage-dividing resistors.

The buffer unit 153 consists of a voltage follower connected, in series, between an output terminal of the multi-channel DAC 152 and the decoder 155. The buffer unit 153 stabilizes the 64 gamma voltages selected for each mode and applies them to the decoder 155. The data input 154 includes an inverter for inverting a logical value of each data bit so as to generate an inverted signal and a non-inverted signal of the data and to apply them to the decoder 155. The decoder 155 consists of a plurality of logical elements in an array so as to select any one of the 64 gamma voltages in accordance with the inverted and non-inverted data from the data input 154 and to apply the selected gamma voltage to the output buffer 156. The multi-channel DAC 152 and the buffer unit 153 and the data input 154, the decoder 155 and the output buffer 156 are integrated into a single chip within the column driver 143.

Figure 16:
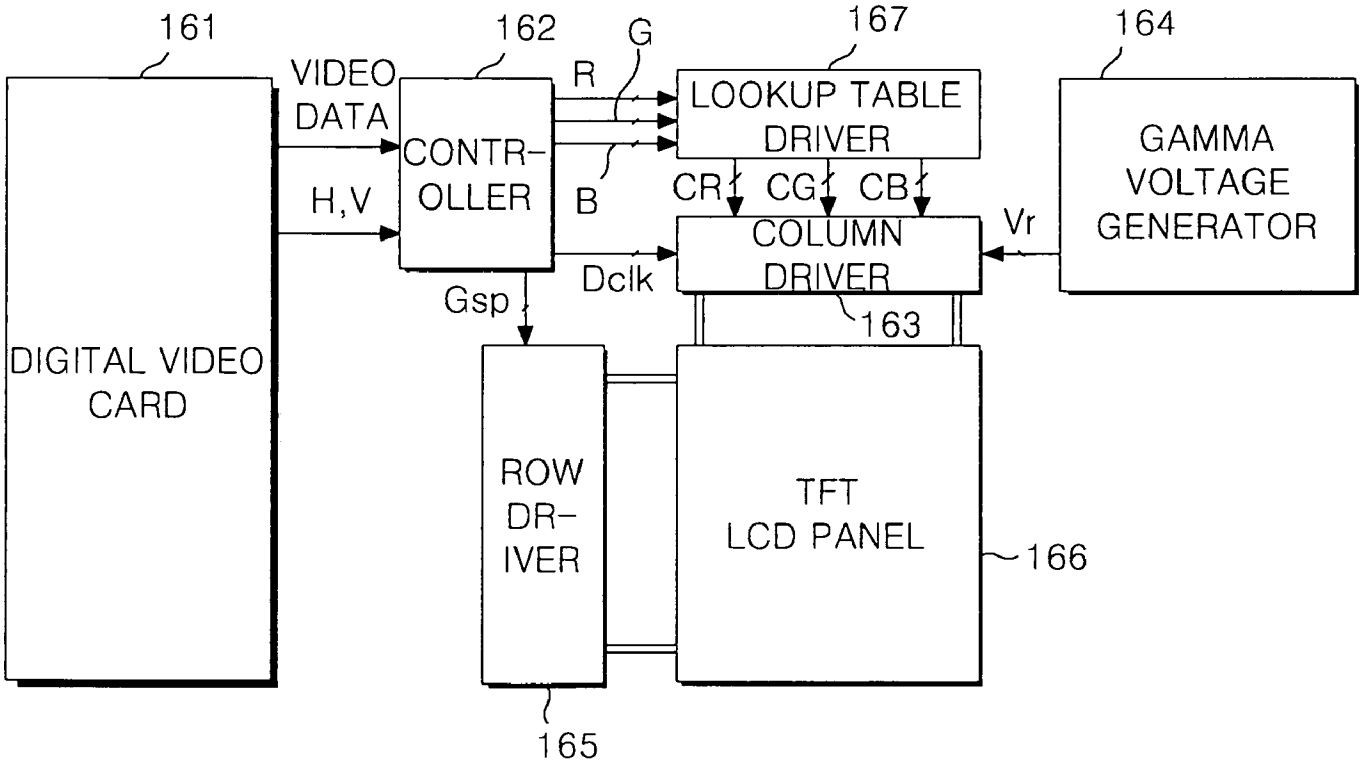
FIG. 16 is a block diagram showing a configuration of a liquid crystal display according to a fourth embodiment of the present invention.

Referring to FIG. 16, there is shown an LCD according to a fourth embodiment. The LCD includes a digital video card 161 for converting an input image signal into digital video data, a column driver 163 for supplying data to data lines DL of a liquid crystal panel 166, a row driver 165 for sequentially driving gate lines GL of a liquid crystal panel 165, a multi-mode gamma voltage generator 164 for generating a gamma voltage, a lookup table driver 167 for correcting a color temperature of video data, and a controller 162 for controlling the column driver 163 and the row driver 165.

The digital video card 161 converts an analog input image signal into a digital image signal suitable for the liquid crystal panel 166 and detects a synchronous signal included in the image signal. The controller 162 supplies R, G and B digital video data from the digital video card 161 to the lookup table driver 167. The controller 162 generates a dot clock Dclk and a gate start pulse GSP using horizontal/vertical synchronizing signals H and V input from the digital video card 161 to perform a timing control of the column driver 163 and the row driver 165.

The column driver 163 is supplied with R, G and B data having color temperatures corrected by the lookup table driver 167. The column driver 163 corrects the color temperature correction data CR, CG and CB from the lookup table driver 167 by a gamma voltage Vγ applied from the gamma voltage generator 164 and supplies the connected data to the data lines DL of the liquid crystal panel 166.

The row driver 165 includes a shift register for responding to the gate start pulse GSP input from the controller 162 to sequentially generate a scanning pulse, and a level shifter for shifting a voltage of the scanning pulse to a voltage level suitable for driving the liquid crystal cell. Video data at the data line DL is applied to a pixel electrode of the liquid crystal cell Clc by the TFT in response to the scanning pulse input from the row driver 165. The gamma voltage generator 164 generates a gamma voltage Vγ set to have a different direct current level in accordance with a gray level value, in consideration of an electro-optical characteristic of the liquid crystal device to be applied to the column driver 163.

Figure 17:
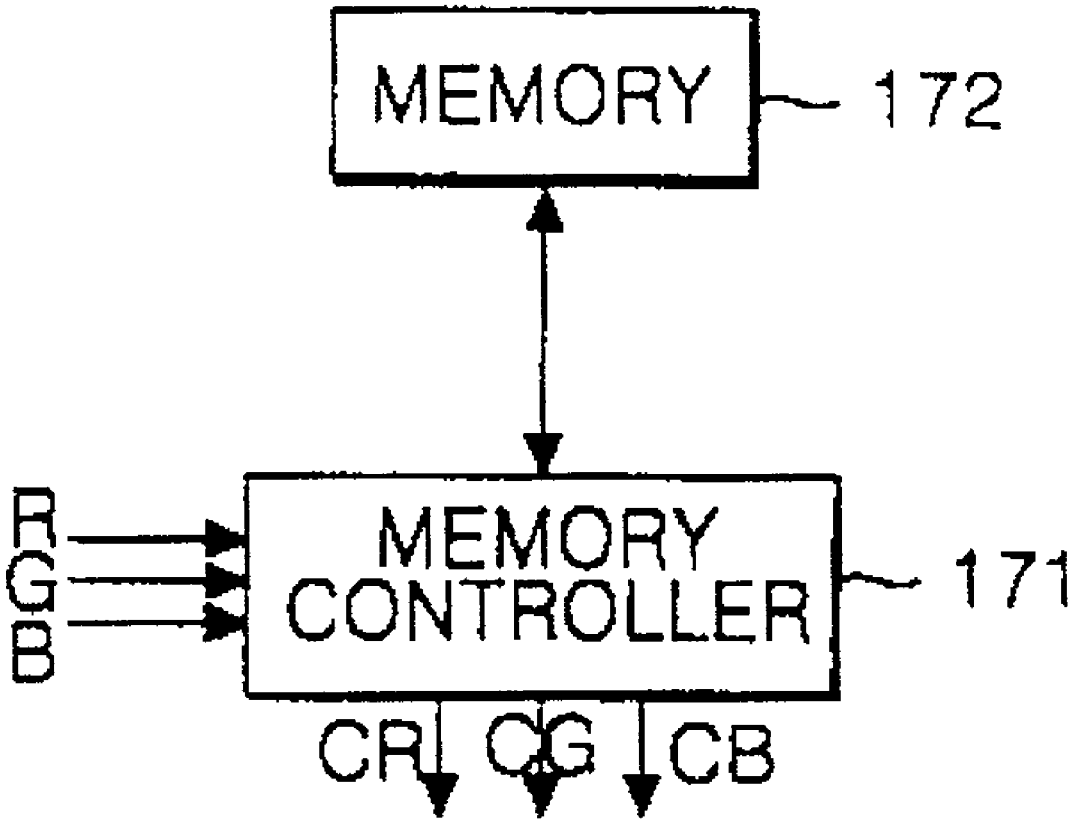
FIG. 17 is a detailed block diagram of the lookup table driver shown in FIG. 16.

The lookup table driver 167 corrects a color temperature of the R, G and B video data from the controller 162 such that a correlative color temperature of data displayed on the liquid crystal panel 166 is identical to a $D_{65}$ light source having approximately 6500 K. As shown in FIG. 17, the lookup table driver 167 includes a memory 172 for storing the color temperature correction data CR, CG and CB, and a memory controller 171 for controlling the memory 172.

Figure 18:
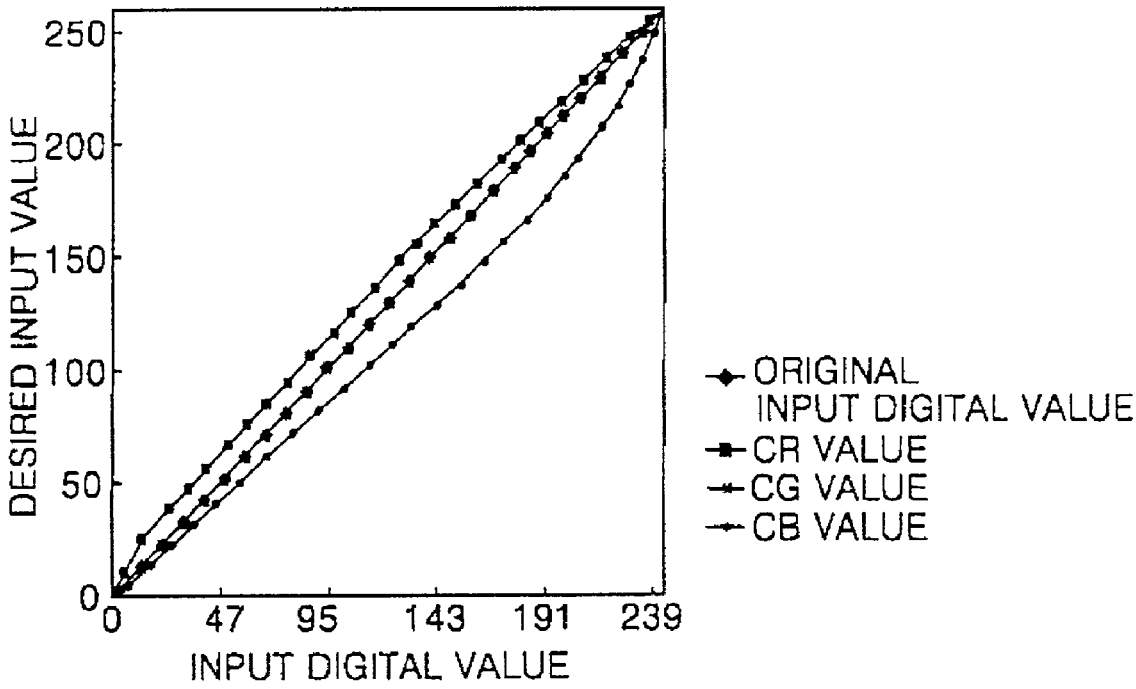
FIG. 18 is a characteristic graph representing gray levels of data having a color temperature corrected by means of the lookup table driver shown in FIG. 16 and an input digital video data.

The color temperature correction data CR, CG and CB stored in the memory 172 is determined by a procedure to be described below. First, the conventional LCD having no lookup table driver is driven to measure gray level values of input digital video data R, G and B and a correlative color temperature of a display image according to the gray level values. The gray level values of the input video digital data R, G and B are adjusted such that color co-ordinates according to each gray level value of the input digital video data R, G and B becomes $D_{65}$ and the brightness maintains the brightness values of the input digital video data R, G and B as they were before color correction. If a display image for this adjusted data is identical to color co-ordinates of the $D_{65}$ light source and the brightness of the input digital video data R, G and B is maintained as-is, then the adjusted data is stored as color temperature correction data CR, CG and CB in the lookup table memory 172. The color temperature correction data CR, CG and CB other than the color temperature correction data CR, CG and CB, determined in this manner, is determined by a linear interpolation as shown in FIG. 18.

The memory controller 171 reads out from the memory 172 the color temperature correction data CR, CG and CB corresponding to gray level values of the video data R, G and B input from the timing controller 162 and supplies the data to the column driver 163.

Since the conventional LCD has a high correlative color temperature, it expresses a blue color mainly. On the other hand, in the LCD according to the present invention, a brightness value of the blue color temperature correction data CB reduced to be less than that of the input digital video data R, G and B as can be seen from FIG. 18. A brightness value of the red color temperature correction data CR is increased to be more than that of the input digital video data R, G and B. A brightness value of the green color temperature correction data CG is virtually unchanged and is almost identical to that of the input digital video data R, G and B. For instance, when brightness values of the red, green and blue digital video data R, G and B in the conventional LCD having no lookup table driver are 195, 195 and 195, respectively, a brightness value of a real display image is 111cd/$m^2$.

A brightness value of the red color temperature correction data CR correcting such input digital video data R, G and B is increased to 204, while a brightness value of the blue color temperature correction data CB is decreased into 180. A brightness value of the green color temperature correction data CG becomes 195, which is identical to that of the green input digital video data G. A real display image for the color temperature correction data CR, CG and CB after correcting the input digital video data in this manner has a brightness value of 111 cd/$m^2$, which is equal to that of the input digital video data before the correction.

If a gray level range to be displayed is 0 to 255, then values close to 0 (i.e., a minimum value of the linear correction data CR, CG and CB) and 255 (i.e., a maximum value of the linear correction data CR, CG and CB) are not corrected to maintain the contrast ratio, and become identical to those of the input digital video data. Such non-correction of values close to a gray level value of 0 is caused by a fact that such correction almost does not make a color correction effect because a color perceiving ability of an observer is deteriorated in accordance with a reduction of the brightness in light of an observer's eyesight characteristic.

Figure 19:
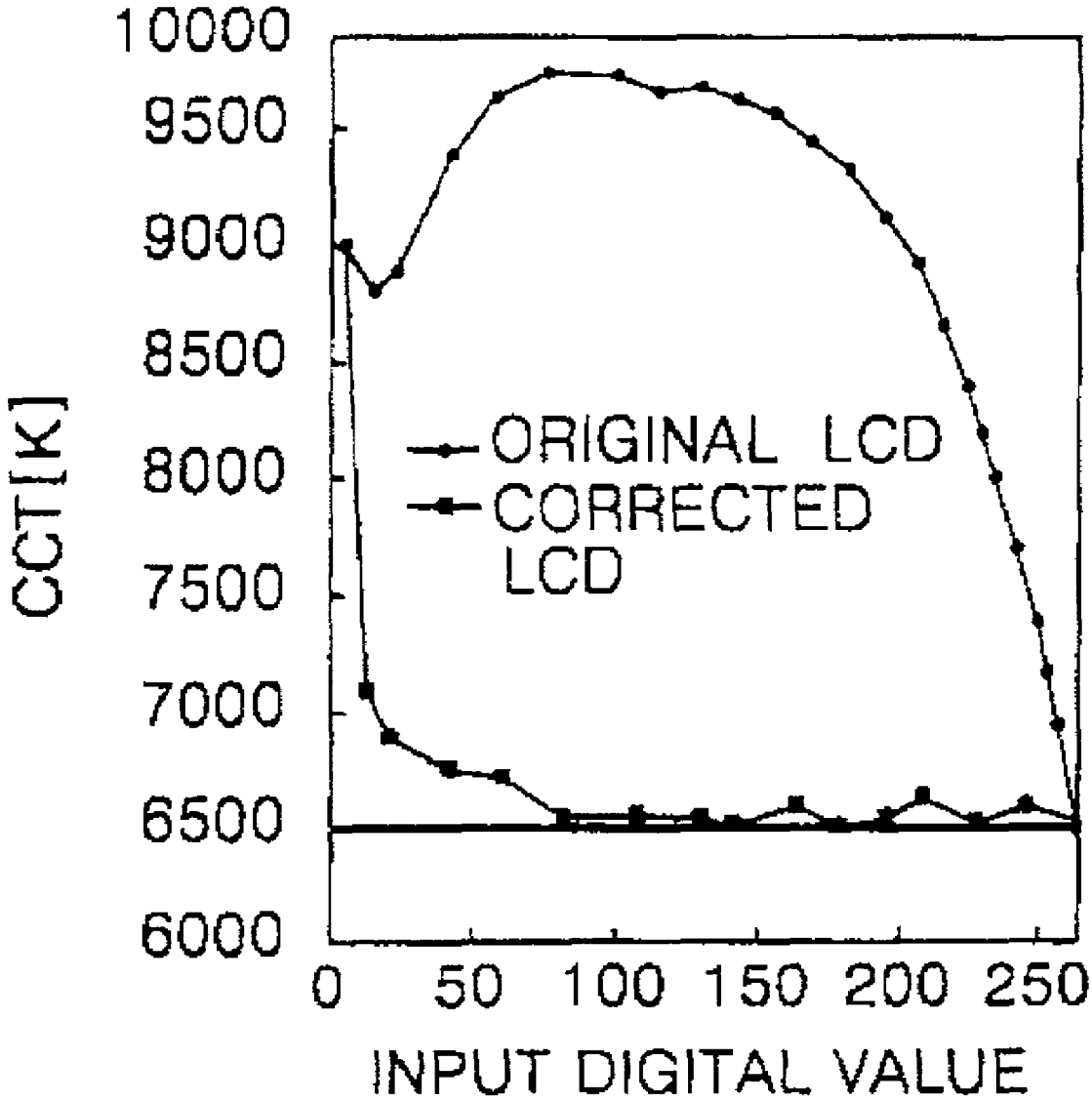
FIG. 19 is a characteristic diagram for comparing a corrected color temperature in the present liquid crystal panel with the color temperature in the convention liquid crystal panel.

FIG. 19 shows the result of a modeling experiment for obtaining a color temperature characteristic of a real image displayed on the liquid crystal panel 166 after correcting data using the color temperature correction data CR, CG and CB.

Referring to FIG. 19, a color temperature of the conventional LCD varies over a range of approximately 8800 K to 9800 K with respect to a gray level range of the input digital video data corresponding to a range of 0 to 100, while it varies over a range of approximately 9800 K to 6500 K with respect to a gray level range of the input digital video data corresponding to a range of 100 to 255. The conventional LCD has a correlative color temperature characteristic distributed widely, whereas an LCD having corrected the input digital video data using the color temperature correction data CR, CG and CB maintains a color temperature of about 6500 K, equal to the $D_{65}$ light source, in all gray level values except a gray level range of 0 to 50. The LCD according to the present invention allows color co-ordinates for each gray level value to be almost constantly maintained as shown in FIG. 20.

Figure 21:
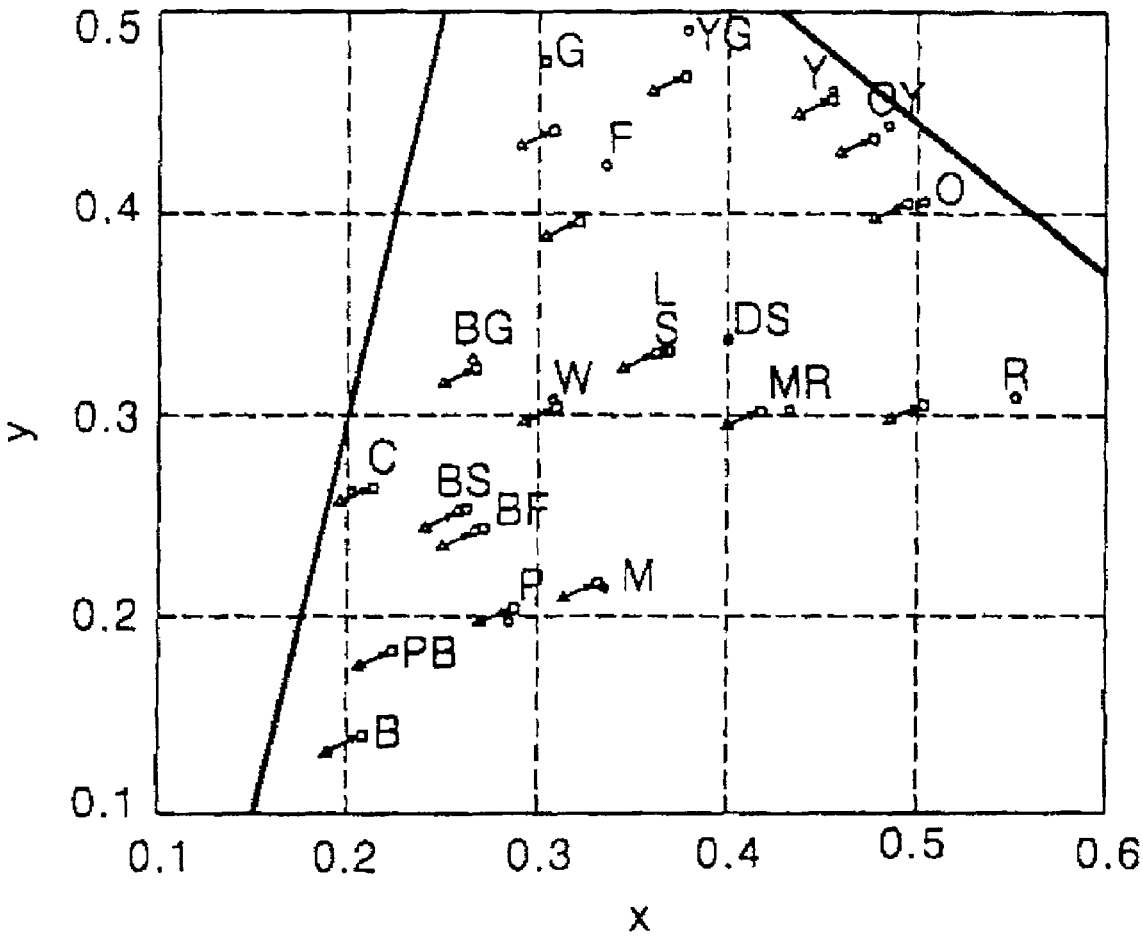
FIG. 21 is a characteristic graph comparing chrominance co-ordinates of an input image with those of a displayed image in the conventional liquid crystal panel so as to show a color reappearance effect according to a color temperature correction.

As can be seen from FIG. 21, there is a large difference between chrominance coordinates of the input digital video data R, G and B and those of a real image displayed on the liquid crystal panel 166. On the other hand, the LCD of FIG. 16 displays data corrected by the color temperature correction data CR, CG and CB in the lookup table, thereby allowing chrominance co-ordinates of a real image on the liquid crystal panel 168 to be almost close to the input digital video data R, G and B so as to make a natural expression of a desired color.

Figure 20:
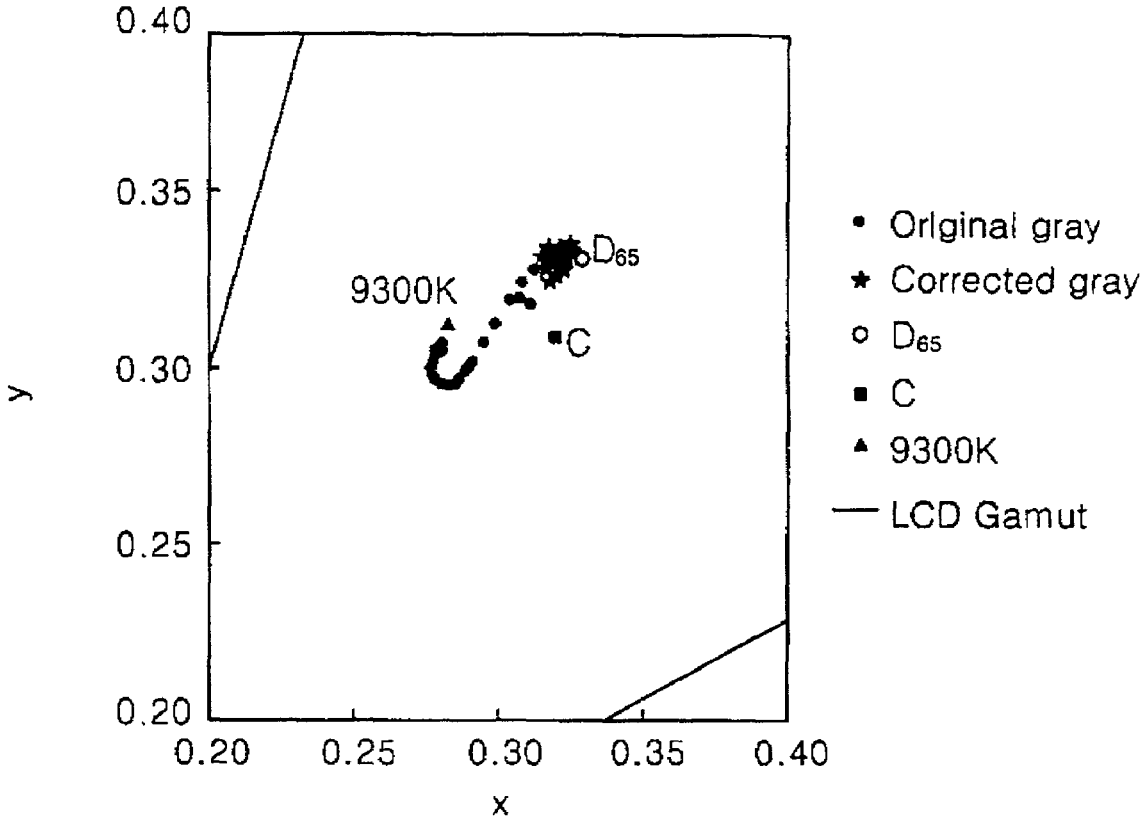
FIG. 20 is a characteristic graph representing a correlative color temperature of the liquid crystal panel having a corrected color temperature.

In FIG. 20 and FIG. 21, the horizontal axis and the vertical axis represent independent parameters x and y, respectively, in the CIE co-ordinate system.

As described above, according to the present invention, gamma data is stored in the memory for each mode corresponding to various peripheral equipment interchangeable with the LCD, and a desired gamma voltage is generated according to gamma data having a specified mode selected by a user, using the gamma data for each mode stored in the memory. Further, a color temperature characteristic from the input digital video data is corrected in consideration of a color temperature characteristic of the liquid crystal panel. Such a color temperature characteristic correction maintains the brightness and contrast of an input image as-is, to thereby make a natural expression of a desired color on the liquid crystal panel. Accordingly, it becomes possible to improve a display quality of an image input from various peripheral equipment interchangeable with the LCD as well as to provide a better picture quality by a correction of a color temperature characteristic displayed on the liquid crystal panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display (LCD) device having a gamma voltage correcting apparatus, wherein the LCD device has a display panel that includes a plurality of pixels defined by gate lines and data lines, said LCD device comprising:

a display controller for receiving video data and vertical and horizontal synchronizing signals and outputting the video data and a clock;

the gamma voltage correction apparatus including;

a memory means for storing at least two sets of digital gamma data for at least two input modes, a gamma control means for accessing one set of the digital gamma data in response to a selection signal, a multi-channel gamma voltage generator having a plurality of digital to analog converters (DACs), the digital to analog converters generating n gamma voltages (wherein n is an integer) having a different voltage level in response to the digital gamma data respectively, and a column driver connected to the display panel, wherein the column driver receives the video data and the clock from the display controller and the n gamma voltages from the gamma voltage correction apparatus, and then corrects the video data using the n gamma voltages and applies the corrected video data to the data lines.

2. The gamma voltage correcting apparatus according to claim 1, wherein the selection signal is provided to the gamma voltage correction apparatus by a user.

3. The gamma voltage correcting apparatus according to claim 1, further comprising a buffer unit for buffering a signal having the gamma voltage from the multi-channel gamma voltage generator to apply it to the column driver.

4. The gamma voltage correcting apparatus according to claim 1, further comprising a voltage-dividing resistor for dividing the n gamma voltages into m gamma voltages (wherein m is an integer larger than n) having a different voltage level.

5. The gamma voltage correcting apparatus according to claim 1, wherein the multi-channel gamma voltage generator includes:

a data receiver for receiving the gamma data and a clock signal in the mode selected by the control means; and a reference voltage generator for dividing an externally supplied supply voltage to generate a plurality of reference voltages having a different voltage level;

wherein the digital to analog converters select the reference voltages in response to the digital gamma data to generate the gamma voltages, respectively.

6. The gamma voltage correcting apparatus according to claim 1, wherein the memory means and the control means are integrated into a single integrated circuit.

7. The gamma voltage correcting apparatus according to claim 2, further comprising:

a row driver for sequentially applying a scanning pulse to the gate lines to drive the gate lines; and a timing controller for supplying red, green and blue digital video data to the column driver and for applying a desired timing control signal to the row driver.

8. The gamma voltage correcting apparatus according to claim 7, wherein the memory means, the control means and the timing controller are integrated into a single integrated circuit.

9. A method of correcting a gamma voltage in a liquid crystal display wherein a liquid crystal pixel is arranged at each intersection between data lines and gate lines and video data is corrected by a preset gamma voltage to display an image, said method comprising:

receiving video data and vertical and horizontal synchronizing signals and outputting the video data and a clock;

storing at least two sets of digital gamma data for at least two input modes;

accessing the digital gamma data in response to an instruction from a user;

selecting one set of the digital gamma data for each mode;

responding to the one set of the gamma data for the selected mode to generate n gamma voltages (wherein n is an integer) having a different voltage level using a plurality of digital to analog converters (DACs), the digital to analog converters responding to the digital gamma data respectively;

correcting the video data using the n gamma voltages; and applying the corrected video data to the data lines.

10. The method according to claim 9, wherein the gamma data is set differently in accordance with each mode set in correspondence with peripheral equipment interchangeable with the liquid crystal display.

11. The method according to claim 9, wherein the digital gamma data is set differently in accordance with each mode set in correspondence with an optical recording medium player, a television image signal display device, and a camcoder.

12. The method according to claim 9, further comprising the steps of:

dividing the n gamma voltages into m gamma voltages (wherein m is an integer larger than n) having a different voltage level; and correcting the video data using the m gamma voltages and supplying the corrected video data to the data lines.

13. The method according to claim 12, further comprising:

buffering the m gamma voltages and applying the buffered m gamma voltages to the column driver.

14. A device for providing a desired gamma voltage for a liquid crystal display (LCD), said device comprising:

a memory for storing a plurality of digital gamma data corresponding to a plurality of modes;

a controller for receiving an external mode signal and in response thereto selecting selected digital gamma data from the memory;

a reference voltage generator for receiving a supply voltage and generating a plurality of reference voltages;

a plurality of digital-to-converters (DACs) selecting the reference voltages in response to the digital gamma data to generate n gamma voltages (wherein n is an integer) having a different voltage level, respectively;

wherein each of the plurality of modes corresponds to a different source video generator for providing video data to the LCD.

15. The device of claim 14, wherein the gamma voltage generator comprises a resistor divider network.

16. A method of providing a desired gamma voltage for a liquid crystal display having a plurality of pixels defined by gate lines and data lines, comprising:

receiving video data and vertical and horizontal synchronizing signals and outputting the video data and a clock;

storing a plurality sets of digital gamma data corresponding to a plurality of modes in a memory device;

receiving an external mode signal and in response thereto selecting selected digital gamma data from the memory;

generating a plurality of gamma reference voltages according to the selected gamma data;

generating a plurality of gamma voltages from the plurality of gamma reference voltages using a plurality of digital-to-converters (DACs), the DACs selecting the reference voltages in response to the digital gamma data to generate the gamma voltages having a different voltage level, respectively;

correcting the video data using the gamma voltages; and applying the corrected video data to the data lines.

17. The method of claim 16, wherein generating the plurality of gamma reference voltages comprises:

receiving a supply voltage and generating therefrom a plurality of reference voltages; and generating the plurality of gamma reference voltages from the gamma data and the plurality of reference voltages.

18. The method of claim 17, wherein generating the a plurality of gamma voltages comprises dividing the plurality of gamma reference voltages in a divider network.

19. A display device having a gamma voltage correcting part, wherein the display device has a display panel that includes a plurality of pixels defined by gate lines and data lines, the display device comprising:

a display controller for receiving video data and vertical and horizontal synchronizing signals and outputting the video data and a clock;

the gamma voltage correction part including;

a memory for storing at least two sets of digital gamma data for at least two input modes, a gamma controller for accessing one set of the digital gamma data in response to a selection signal, a plurality of digital-to-converters (DACs) generating n gamma voltages (wherein n is an integer) having a different voltage level in response to the digital gamma data, respectively, and a column driver connected to the display panel, wherein the column driver receives the video data and clock from the display controller and the n gamma voltages from the gamma voltage correction part, and then corrects the video data using the n gamma voltages and applies the corrected video data to the data lines.

20. The display device according to claim 19, wherein the selection signal is provided to the gamma voltage correction apparatus by a user.

21. A display device having a gamma voltage correcting part, wherein the display device has a display panel that includes a plurality of pixels defined by gate lines and data lines, the display device comprising:

a display controller for receiving a first video data and vertical and horizontal synchronizing signals and outputting a second video data and a clock;

a lookup table driver connected to the display controller for adjusting color temperature of the second video data and outputting a third video data;

the gamma voltage correction part including;

a memory for storing at least two sets of gamma data for at least two input modes, a gamma controller for accessing one set of the gamma data in response to a selection signal, a multi-channel gamma voltage generator for responding to the one set of the gamma data to generate n gamma voltages (wherein n is an integer) having different voltage levels, and a column driver connected to the display panel, wherein the column driver receives the third video data and the n gamma voltages, and then corrects the third video data using the n gamma voltages and applies the corrected video data to the data lines.

22. The display device according to claim 21, further comprising:

a row driver for sequentially applying a scanning pulse to the gate lines; and a timing controller for supplying timing control signals to the row and column drivers.

23. The display device according to claim 21, wherein a color temperature of the corrected video data maintains approximately 6500 K.

24. The display device according to claim 21, wherein the corrected video data maintains a brightness and a contrast equal to the first video data.

* * * * *